US010902835B2

(12) United States Patent
Ohtsu et al.

(10) Patent No.: US 10,902,835 B2
(45) Date of Patent: Jan. 26, 2021

(54) SOUNDPROOF STRUCTURE

(71) Applicant: FUJIFILM Corporation, Tokyo (JP)

(72) Inventors: Akihiko Ohtsu, Ashigara-kami-gun (JP); Shogo Yamazoe, Ashigara-kami-gun (JP); Shinya Hakuta, Ashigara-kami-gun (JP); Yoshihiro Sugawara, Ashigara-kami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 16/541,403

(22) Filed: Aug. 15, 2019

(65) Prior Publication Data

US 2020/0005757 A1 Jan. 2, 2020

Related U.S. Application Data

(63) Continuation of application No. PCT/JP2018/002137, filed on Jan. 24, 2018.

(30) Foreign Application Priority Data

Feb. 16, 2017 (JP) ..... 2017-027226

(51) Int. Cl.
*G10K 11/172* (2006.01)
*G10K 11/04* (2006.01)
(Continued)

(52) U.S. Cl.
CPC ..... *G10K 11/172* (2013.01); *E04B 1/84* (2013.01); *G10K 11/168* (2013.01)

(58) Field of Classification Search
CPC ..... G10K 11/16; G10K 11/172; G10K 11/36; G10K 11/002; G10K 11/02; G10K 11/04;
(Continued)

(56) References Cited

U.S. PATENT DOCUMENTS 2,541,159 A * 2/1951 Geiger ..... E04B 1/84 181/208
4,177,876 A * 12/1979 Pujolle ..... E04B 1/8409 181/284
(Continued)

FOREIGN PATENT DOCUMENTS

CN 102081924 A 6/2011
CN 102282013 A 12/2011
(Continued)

OTHER PUBLICATIONS

International Search Report for PCT/JP2018/002137 dated Apr. 17, 2018 [PCT/ISA/210].
(Continued)

*Primary Examiner* — Edgardo San Martin
(74) *Attorney, Agent, or Firm* — Sughrue Mion, PLLC

(57) ABSTRACT

There is provided a soundproof structure that is small and has high soundproofing performance with respect to sound in a low frequency band.

At least one soundproof cell including a frame having a hole portion and a film fixed to the frame is provided. The film has a surface density distribution. Assuming that a shortest line segment length between high surface density regions and between the high surface density regions and end portions of the hole portions is Δd, a longest line segment length between the end portions of the hole portions is L [m], a Young's modulus of a material of the low surface density region is E [Gpa], an average film thickness of the low surface density region is h [m], and a maximum surface density and a minimum surface density of the film are ρmax and ρmin, a parameter X in the following Equation (1) satisfies the following Inequality (2).

$$X=Eh^2/(\rho max/\rho min)[N] \quad (1)$$

$$(\Delta d/L-0.025)/(0.06)[N]\leq X[N]\leq 10\ [N] \quad (2)$$

12 Claims, 9 Drawing Sheets

(51) Int. Cl.

| | |
|---|---|
| ***E04B 1/82*** | (2006.01) |
| ***E04B 1/84*** | (2006.01) |
| ***G10K 11/168*** | (2006.01) |
| *G10K 11/16* | (2006.01) |
| *G10K 11/02* | (2006.01) |

(58) Field of Classification Search
CPC ..... E04B 1/82; E04B 1/86; E04B 1/84; E04B 1/99; E04B 2001/8272
See application file for complete search history.

(56) References Cited

U.S. PATENT DOCUMENTS

| | | | | |
|---|---|---|---|---|
| 4,371,858 | A * | 2/1983 | Kanoi | H01F 27/33 181/202 |
| 4,442,419 | A * | 4/1984 | Kanoi | H01F 27/33 181/202 |
| 6,478,110 | B1 * | 11/2002 | Eatwell | G10K 11/16 181/207 |
| 7,267,196 | B2 * | 9/2007 | Mathur | F16F 15/0237 181/198 |
| 8,011,472 | B2 * | 9/2011 | Tanase | G10K 11/172 181/286 |
| 8,360,201 | B2 * | 1/2013 | Tanase | G10K 11/172 181/291 |
| 8,752,667 | B2 * | 6/2014 | McKnight | G10K 11/172 181/287 |
| 9,711,129 | B2 * | 7/2017 | Sheng | H02K 35/00 |
| 2005/0194209 | A1 | 9/2005 | Yang et al. | |
| 2007/0014418 | A1 * | 1/2007 | Eatwell | G10K 11/172 381/71.8 |
| 2010/0044148 | A1 * | 2/2010 | Tanase | G10K 11/172 181/198 |
| 2011/0240402 | A1 * | 10/2011 | Chou | F16F 15/04 181/207 |
| 2011/0266088 | A1 | 11/2011 | Koike et al. | |
| 2018/0002919 | A1 | 1/2018 | Yamazoe et al. | |
| 2018/0082668 | A1 * | 3/2018 | Yamazoe | G10K 11/16 |

FOREIGN PATENT DOCUMENTS

| | | | |
|---|---|---|---|
| JP | 07-019154 | A | 1/1995 |
| JP | 11-327563 | A | 11/1999 |
| JP | 2005-250474 | A | 9/2005 |
| JP | 2010-026257 | A | 2/2010 |
| JP | 2016-161720 | A | 9/2016 |
| WO | 2016136973 | A1 | 9/2016 |

OTHER PUBLICATIONS

International Preliminary Report on Patentability for PCT/JP2018/002137 dated Feb. 14, 2019 [PCT/IPEA/409].
Written Opinion dated Apr. 17, 2018 from the International Bureau in counterpart International Application No. PCT/JP2018/002137.
Communication dated Jan. 13, 2020 from the State Intellectual Property Office of the P.R.C. in application No. 201880009812.9.

* cited by examiner

SOUNDPROOF STRUCTURE

CROSS-REFERENCE TO RELATED APPLICATIONS

This application is a Continuation of PCT International Application No. PCT/JP2018/002137 filed on Jan. 24, 2018, which claims priority under 35 U.S.C. § 119(a) to Japanese Patent Application No. 2017-027226 filed on Feb. 16, 2017. The above application is hereby expressly incorporated by reference, in its entirety, into the present application.

BACKGROUND OF THE INVENTION

1. Field of the Invention

The present invention relates to a soundproof structure comprising a frame and a film fixed to the frame. Specifically, the present invention relates to a soundproof structure in which a film has a surface density distribution and which is for selectively absorbing low-frequency target sound.

2. Description of the Related Art

Conventionally, a soundproof structure has been proposed that comprises a frame, a thin film fixed to the frame, and a weight provided on the thin film and that insulates sound by vibration of the thin film having the weight (refer to JP1995-019154B (JP-H07-019154B), JP1999-327563A (JP-H11-327563A), and JP2005-250474A).

JP1995-019154B (JP-H07-019154B) discloses a sound insulation device that is configured to include a thin film on which a weight is regularly fixed and that reduces noise by attenuating vibration of the thin film by canceling out vibration of the entire thin film due to acoustic waves and vibration of a portion divided by the weight. In addition, JP1995-019154B (JP-H07-019154B) discloses a sound insulation device in which two or more thin films are stacked at intervals.

In JP1995-019154B (JP-H07-019154B), since a thin film that is lightweight and has a simple structure and does not require a volume is used, the sound insulation device is versatile and has a sufficient noise reduction effect. In particular, it is possible to reduce noise in a low frequency band.

JP1999-327563A (JP-H11-327563A) discloses a sound insulation member in which an anti-corrosion-treated thin steel plate with a plurality of weights fixed regularly on one surface is bonded to at least one opening of a rigid frame body so as to cover the opening with the weight fixed surface inside.

JP1999-327563A (JP-H11-327563A) further improves JP1995-019154B (JP-H07-019154B), so that the sound insulation member is lightweight, highly versatile, and excellent in sound insulation performance (in particular, noise reduction performance in a low frequency band), workability, durability, and appearance and accordingly an effect as a sufficient noise reduction member is obtained even in a case where the sound insulation member is applied to the exterior material of a building.

JP2005-250474A discloses a sound attenuation panel which includes a rigid frame divided into a plurality of individual cells, a sheet of flexible material, and a plurality of weights and in which each weight is fixed to the sheet of flexible material so that the weight is provided in each cell.

In JP2005-250474A, sound attenuation can be performed over a wide frequency range.

SUMMARY OF THE INVENTION

Compared with the related art, the sound insulation structures disclosed in JP1995-019154B (JP-H07-019154B) and JP1999-327563A (JP-H11-327563A) are lightweight and simple structures with high versatility, and a sufficient noise reduction effect is obtained. In particular, the sound insulation performance in a low frequency band is excellent. However, in the sound insulation structures disclosed in JP1995-019154B (JP-H07-019154B) and JP1999-327563A (JP-H11-327563A), a metal piece is used as a weight, a thin steel plate is used as a film, and the purpose is being applied to the exterior material of a building. Accordingly, there has been a problem that the sound insulation structures are heavy and large.

The soundproof structures described in the above JP1995-019154B (JP-H07-019154B), JP1999-327563A (JP-H11-327563A), and JP2005-250474A cannot be said to be sufficient for obtaining high sound absorption performance in a state in which a region serving as a ventilation hole through which gas passes is provided. In addition, there is a problem that the sound absorption performance cannot be said to be sufficient in a case where neither the traveling direction of the acoustic wave nor the normal vector of the film surface is horizontal (that is, parallel).

Incidentally, the applicant has filed an invention of a "soundproof structure in which a soundproof cell comprising a frame having a hole portion and a film fixed to the frame so as to cover the hole portion is disposed in an opening member having an opening in a state in which the film surface of the film is inclined with respect to the opening cross section and a region serving as a ventilation hole through which gas passes is provided in the opening member" as an international application PCT/JP2016/074427.

In the above invention, in order to absorb lower sound with the same size, it is necessary to increase the film size or the rear surface volume. Such an increase in the size of an element makes it difficult to use the element, for example, in a case where the space is limited, that is, in a narrow duct or a ventilation sleeve. In addition, as a method of absorbing low frequency sound without increasing the size of the soundproof structure, there is a method of optimizing the modulus of elasticity and/or the density of the film. In this method, however, there is a problem that the absorbance is reduced even though the absorption peak can be made in the low frequency band.

In order to solve the aforementioned problems of the related art, it is an object of the present invention to provide a soundproof structure that is small and has high soundproofing performance with respect to sound in a low frequency band.

More specifically, it is an object of the present invention to provide a soundproof structure capable of absorbing sound in a lower frequency band with a high sound absorption rate, in particular, absorbing sound in a low frequency band without increasing the size, in a case where the space volume used for a film type sound absorbing material having a rear air layer is limited.

In order to achieve the aforementioned object, the present inventors have made the present invention by providing a surface density distribution on the film fixed to the frame so as to cover the hole portion under predetermined conditions (for example, providing a protruding portion or a weight on the film) so that a film having low bending stiffness and high surface density in a pseudo manner is realized and by finding an effective film parameter range for absorbing sound in a lower frequency band with a high sound absorption rate in a case where the space volume used for the film type sound absorbing material having a rear air layer is limited.

That is, a soundproof structure of a first aspect of the present invention is a soundproof structure comprising at least one soundproof cell which comprises a frame having a hole portion and a film fixed to the frame so as to cover the hole portion and in which a rear space of the film is closed. The film has a surface density distribution including a high surface density region and a low surface density region. Assuming that a shortest line segment length among line segments connecting end portions of the high surface density regions adjacent to each other and line segments connecting the high surface density regions and end portions of the hole portions of the frame to each other is Δd, a longest line segment length among line segments connecting the end portions of the hole portions of the frame to each other is L [m], a Young's modulus of a material of the low surface density region is E [Gpa], an average film thickness of the low surface density region is h [m], a maximum surface density of the film is ρmax, and a minimum surface density of the film is ρmin, a parameter X of the film defined by the following Equation (1) satisfies the following Inequality (2).

$$X=Eh^2/(\rho max/\rho min)[N] \quad (1)$$

$$(\Delta d/L-0.025)/(0.06)[N]\leq X[N]\leq 10[N] \quad (2)$$

Here, the numerical value 0.025 in the left side numerator of the above inequality is dimensionless, and the numerical value 0.06 of the left side denominator has a dimension of $[N^{-1}]$.

Here, it is preferable that a ratio ρmax/ρmin between the maximum surface density ρmax of the film and the minimum surface density ρmin of the film is 1.5 or more.

It is preferable that the film is formed of two or more kinds of materials.

It is preferable that the film has a protruding portion or a weight forming the high surface density region.

It is preferable that the film having the protruding portion is a resin film having unevenness.

It is preferable that the film and the frame are integrally formed.

It is preferable that the soundproof cell is smaller than a wavelength of a first natural vibration frequency of the film.

It is preferable that the first natural vibration frequency is 100000 Hz or less.

A method of manufacturing a soundproof structure of a second aspect of the present invention comprises manufacturing the film having the protruding portion by forming unevenness on the film by resin molding or imprinting at the time of manufacturing the soundproof structure comprising the film having the protruding portion of the first aspect described above.

A method of manufacturing a soundproof structure of a third aspect of the present invention comprises forming the film and the frame together with a 3D printer at the time of manufacturing the soundproof structure of the first aspect described above.

According to the present invention, it is possible to provide a soundproof structure that is small and has high soundproofing performance with respect to sound in the low frequency band.

In addition, according to the present invention, it is possible to absorb sound in the lower frequency band with a high sound absorption rate in a case where the space volume used for a film type sound absorbing material having a rear air layer is limited. According to the present invention, in particular, sound in the low frequency band can be absorbed without increasing the size.

Therefore, according to the present invention, for example, it is possible to obtain a high sound absorption rate in a frequency band lower than in the related art with the same size as in the related art.

DESCRIPTION OF THE PREFERRED EMBODIMENTS

Hereinafter, a soundproof structure according to one embodiment of the present invention will be described in detail with reference to preferred embodiments shown in the accompanying diagrams.

Figure 1:
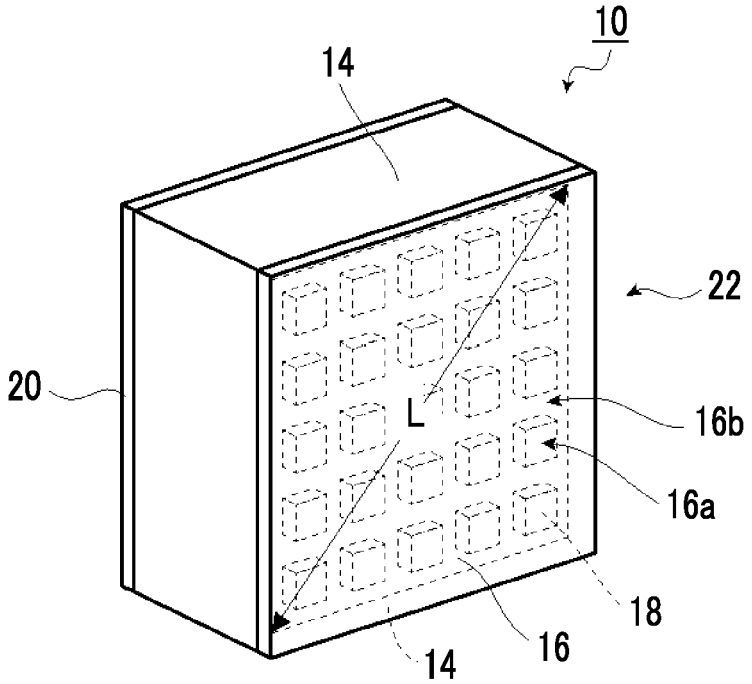
FIG. 1 is a schematic perspective view of an example of a soundproof structure according to an embodiment of the present invention.
Figure 2:
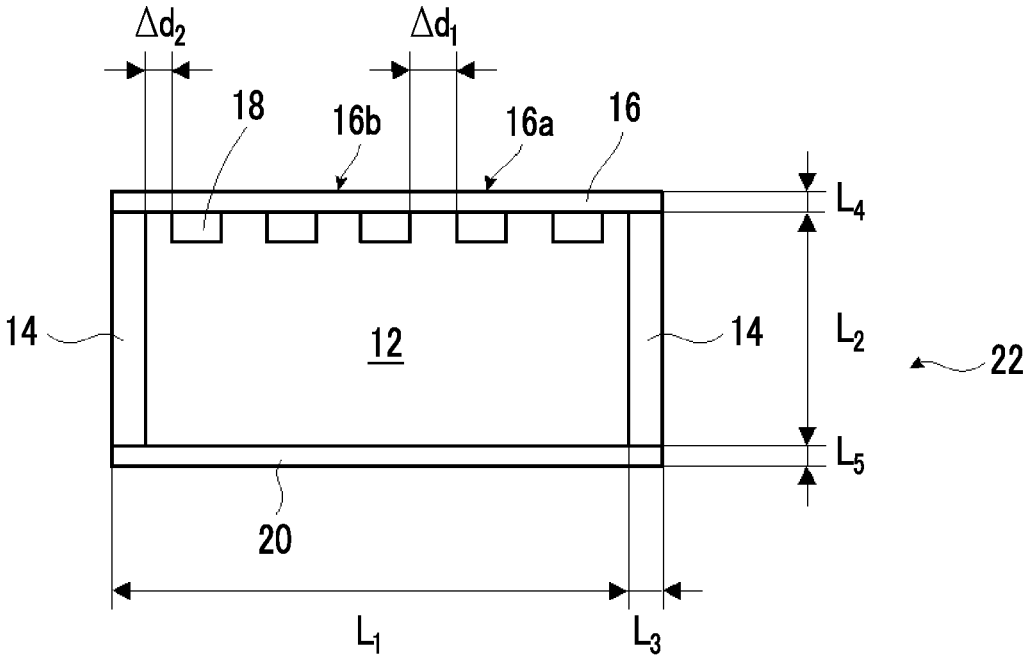
FIG. 2 is a schematic cross-sectional view of the soundproof structure shown in FIG. 1.

FIG. 1 is a schematic perspective view of an example of the soundproof structure according to one embodiment of the present invention. FIG. 2 is a schematic cross-sectional view of the soundproof structure shown in FIG. 1.

(Soundproof Structure)

A soundproof structure 10 of the present embodiment shown in FIGS. 1 and 2 is configured to include one soundproof cell 22 having a frame 14 having a hole portion 12 penetrating therethrough, a vibratable film 16 fixed to the frame 14 so as to cover one opening surface of the hole portion 12, a plurality of (for example, 25) protruding portions 18 formed on the film 16, and a rear member 20 fixed to the frame 14 so as to cover the other opening surface of the hole portion 12.

In the present invention, a portion (region) of the film 16 in which the protruding portion 18 is provided has a surface density obtained by adding up the surface density of the film 16 and the surface density of the protruding portion 18. Accordingly, the portion (region) of the film 16 in which the protruding portion 18 forms a high surface density region 16*a* of the film. In the soundproof structure of the present invention, instead of the protruding portion 18, a weight may be attached to the film 16 to form the high surface density region 16*a* including the film 16 and the weight. The high surface density region 16*a* may be formed in at least one place of the film 16.

A portion of the film 16 in which no protruding portion is formed (that is, a portion other than the high surface density region 16*a*) forms a low surface density region 16*b* of the film.

That is, the film 16 has a surface density distribution including the high surface density region 16*a* and the low surface density region 16*b*.

In the soundproof cell 22 of the soundproof structure 10 of the present embodiment, a rear space of the film 16 surrounded by the inner peripheral surface of the frame 14 and the rear member 20 is closed by the rear member 20. The soundproof structure of the present invention may be configured to include one or more soundproof cells.

The soundproof structure of the present invention may be one having one soundproof cell as in the soundproof structure 10 shown in FIG. 1 or may be one having a plurality of soundproof cells.

In the soundproof structure 10 of the present invention, assuming that the shortest line segment length among line segments connecting the end portions of the adjacent high surface density regions 16*a* to each other and line segments connecting the high surface density regions 16*a* and the end portions of the hole portions 12 of the frame 14 to each other is Δd, the longest line segment length among line segments connecting the end portions of the hole portions 12 of the frame 14 to each other is L [m], the Young's modulus of the material of the low surface density region 16*b* is E [Gpa], the average film thickness of the low surface density region 16*b* is h [m], the maximum surface density of the film 16 is ρmax, and the minimum surface density of the film 16 is ρmin, a parameter X of the film 16 defined by the following Equation (1) satisfies the following Inequality (2).

$$X=Eh^2/(\rho max/\rho min)[N] \quad (1)$$

$$(\Delta d/L-0.025)/(0.06)[N]\leq X[N]\leq 10[N] \quad (2)$$

Here, the numerical value 0.025 in the left side numerator of the above inequality is dimensionless, and the numerical value 0.06 of the left side denominator has a dimension of $[N^{-1}]$.

(High Surface Density Region and Low Surface Density Region of Film)

In the soundproof structure 10 shown in FIGS. 1 and 2, the high surface density region 16*a* and the low surface density region 16*b* are a portion of the film 16 in which the protruding portion 18 is provided and a portion of the film 16 in which the protruding portion 18 is not provided, respectively. However, the present invention is not limited thereto, and can be defined as follows.

Assuming that the surface density on the film surface of the film 16 is ρ(r) and the surface density average value is ρave, the surface density average value $\rho ave=\int\rho(r)dS/S$ is defined. This integral indicates area integral over the entire film surface, and S is the film area.

In practice, it may be difficult to obtain the value of the surface density ρ(r) continuously over the entire surface of the film 16. In this case, for example, the surface density ρ(r) can be measured at a plurality of points over the entire film surface at intervals of 1 mm or less, and the averaged value can be used as the surface density average value ρave.

As described above, as means for realizing the surface density distribution, the protruding portion 18 can be provided on the film 16, or a weight can be attached. The surface density ρ of the film at this time is defined as a mass $[g/\mu m^2]$ corresponding to per unit area $[\mu m^2]$. In a case where the surface density distribution is very small, it is preferable to calculate a mass corresponding to the area of a small square region having a length corresponding to a frequency sufficiently higher (for example, about 10 times higher) than the average frequency of the in-plane spatial frequency distribution of the surface density.

Here, a region where ρ(r)>ρave is satisfied can be defined as the high surface density region 16*a*, and a region where ρ(r)≤ρave is satisfied can be defined as the low surface density region 16*b*.

By defining the high surface density region 16*a* and the low surface density region 16*b* as described above, each point on the film surface of the film 16 can be classified into either the high surface density region 16*a* or the low surface density region 16*b* from the above-described inequality. For example, as described above, in a case where the surface density ρ(r) is measured at a plurality of points at intervals of about 1 mm or less, any of the points can be classified into either the high surface density region 16*a* or the low surface density region 16*b* with reference to the above-described inequality.

The end portion of the high surface density region 16*a* can be defined as a point at which the high surface density region 16*a* is switched to the low surface density region 16*b*. For example, in a case where the surface density ρ(r) is measured at a plurality of points at intervals of about 1 mm or less, assuming that the point of the high surface density region 16*a* and the point of the low surface density region 16*b* are adjacent to each other, the end portion of the high surface density region 16*a* can be defined as a midpoint between the two adjacent points.

The average film thickness h [m] of the low surface density region 16*b* is defined as an average value of the film thickness of a portion corresponding to the low surface density region 16*b*. For example, since the protruding portion 18 or the weight is provided in the film 16, the average film thickness h is an average value of the thickness of the portion of the film 16 in which the protruding portion 18 or the weight is not provided. In a case where the surface density ρ(r) is measured at a plurality of points at intervals of about 1 mm or less, the average film thickness h is an average value of the film thicknesses of all the points classified into the low surface density region 16*b*.

(Surface Density of Film)

ρmax and ρmin indicate a maximum value (that is, a maximum surface density) and a minimum value (that is, a minimum surface density) of the surface density, respectively. For example, in a case where the surface density ρ(r) is measured at a plurality of points over the entire film surface at intervals of about 1 mm or less, a surface density that is the maximum is defined as the maximum surface density, and a surface density that is the minimum is defined as the minimum surface density.

In the present invention, as described above, the film has a surface density distribution within the film surface. The surface density of the film is preferably designed so that a ratio ρmax/ρmin between the maximum surface density ρmax of the film and the minimum surface density ρmin of the film is 1.5 or more, more preferably 3.0 or more, and even more preferably 5.0 or more. The reason is that, in a case where ρmax/ρmin is smaller than 1.5, it is difficult to generate an absorption peak in a frequency band (specifically, ⅔ or less) that is significantly low compared with a film in a case where there is no surface density distribution of a film (for example, a film having a uniform surface density of ρmin).

(Parameter X of Film)

For sound absorption in a low frequency band, a film type sound absorbing material needs low bending stiffness and high surface density. From this, as means for realizing this in a pseudo manner, it is effective to provide the film 16 with a density distribution as described above. In a case where the surface density distribution is provided in the film 16, in general, a region with a high surface density (high surface density region) has high bending stiffness, and a region with a low surface density (low surface density region) has low bending stiffness. For this reason, depending on the design, the film 16 can behave like a film having low bending stiffness and high surface density in a pseudo manner with respect to acoustic waves.

That is, as in the soundproof structure 10 of the present invention, the film type sound absorbing material having a rear air layer, which is easy to bend and heavy, can absorb sound in a lower frequency band with a high sound absorption rate.

As a guide for this design method, the above Equation (1) is effective.

Therefore, in the present invention, as shown in the above Equation (1), the parameter X of the film 16 is calculated as a value obtained by dividing the product of the Young's modulus E of the material of the film 16 (low surface density region 16*b*) and the square of the average film thickness h [m] by the ratio ρmax/ρmin between the maximum surface density and the minimum surface density of the film 16, and both the ease of bending and the weight are used as a measure for evaluation. Here, the Young's modulus E is a longitudinal modulus of elasticity, and is defined as a value obtained by dividing stress in a certain direction by strain. This can be measured experimentally, for example, by a tensile test or indentation method.

In the present invention, a film type sound absorbing material that is easy to bend, has a high density, and is heavy is obtained by forming the protruding portion 18 on the film 16 so that the film 16 has a surface density distribution including the high surface density region 16*a* and the low surface density region 16*b* and by limiting the parameter X of the film 16 to a value satisfying the above-described Inequality (2). In this manner, in the present invention, it is possible to absorb sound in a lower frequency band with a high sound absorption rate even in a case where the space volume used for a film type sound absorbing material having a rear air layer is limited. In the present invention, in particular, sound in a low frequency band can be absorbed without increasing the size.

In the present invention, the parameter X of the film 16 expressed by the above Equation (1) needs to satisfy the above Inequality (2).

The reason is that, in the case of $(\Delta d/L-0.025)/(0.06)>X$, not only the peak frequency of absorption (sound absorption peak frequency) cannot be lowered too much, but also the sound absorption rate (peak of absorption) cannot be increased. This is because, as for the peak frequency of absorption in this case, an absorption peak is obtained at a slightly low frequency compared with, for example, a case where there is no surface density, but the absorbance is significantly reduced (by half or less) compared with, for example, a film having a uniform surface density of ρmin.

In addition, this is because, in a case where X is larger than 10 (X>10), the peak frequency of absorption (sound absorption peak frequency) cannot be lowered. In this case, it is difficult to generate an absorption peak in a significantly low frequency band (specifically, ⅔ or less) compared with, for example, a case where there is no surface density (for example, a film having a uniform surface density of ρmin).

Then, the line segment length Δd [m] in the above Expression (2) is the shortest line segment length among line segments connecting the end portions of the adjacent high surface density regions 16*a* to each other and line segments connecting the high surface density region 16*a* and the end portion of the hole portion 12 of the frame 14 to each other. That is, the line segment length Δd [m] can be defined as the line segment length of a shorter one of two line segments, a shortest line segment among the line segments connecting the end portions of the adjacent high surface density regions 16*a* to each other and a shortest line segment among the line segments connecting the high surface density region 16*a* and the end portion of the hole portion 12 of the frame 14 to each other. For example, in the example shown in FIG. 2, the line segment connecting the end portions of the adjacent high surface density regions 16*a* to each other is a distance $\Delta d_1$ between the adjacent protruding portions 18. In addition, the line segment connecting the high surface density region 16*a* and the end portion of the hole portion 12 of the frame 14 to each other is a distance $\Delta d_2$ between the protruding portion 18 and the inner wall of the hole portion 12. Therefore, in the present invention, the line segment length Δd can be defined as the line segment length of a shorter one of two line segments, a shortest line segment of the line segment $\Delta d_1$ and a shortest line segment of the line segment $\Delta d_2$.

The line segment length L [m] in the above Expression (2) is the longest line segment length among the line segments connecting the end portions of the hole portion 12 of the frame 14 to each other. In the example shown in FIG. 1, since the hole portion 12 is a square, the longest distance between the end portions is the diagonal length L. In the present invention, for example, in a case where the shape of the hole portion 12 is a polygon, the line segment length L is the longest diagonal. For example, the line segment length L is a diameter in a case where the shape of the hole portion 12 is a circle, and is a major diameter in a case where the shape of the hole portion 12 is an ellipse. Even in a case where the shape of the hole portion 12 is any shape, the longest line segment among line segments between the end portions may be the line segment length L.

(Frame)

In the present invention, a member serving as a frame needs to have a hole portion, and it is preferable to block the permeation of gas. In addition, it is necessary to have enough stiffness not to cause vibration with respect to sound. The enough stiffness not to cause vibration with respect to sound is enough stiffness to cause only vibration strain that can be almost neglected compared with strain caused by the vibration of the film. Here, the vibration strain that can be almost neglected is 1/100 or less of the strain caused by the vibration of the film.

The frame 14 of the soundproof cell 22 shown in FIGS. 1 and 2 has an inner wall surface surrounding the hole portion 12 having a square shape in a plan view, and is formed by a square tube having a square shape in a plan view.

Since the frame 14 is formed so as to annularly surround the hole portion 12 penetrating therethrough and fixes and supports the film 16 so as to cover one surface of the hole portion 12, the frame 14 serves as a node of film vibration of the film 16 fixed to the frame 14. Therefore, the frame 14 has higher stiffness than the film 16. Specifically, it is preferable that both the mass and the stiffness of the frame 14 per unit area are high. The frame 14 and the film 16 may be integrated with the same material or different materials.

At least a part of the film 16 need to be fixed to an end portion of the hole portion 12 of the frame 14. For sound absorption in a low frequency region, it is preferable that the entire end portion of the film 16 is fixed to the frame 14.

That is, it is preferable that the frame 14 has a closed continuous shape that allows a peripheral portion of the film 16 to be fixed so as to be able to restrain the entire periphery of the film 16. However, the present invention is not limited thereto. The frame 14 may be made to have a discontinuous shape by cutting a part thereof as long as the frame 14 serves as a node of film vibration of the film 16 fixed to the frame 14. That is, since the role of the frame 14 is to fix and support the film 16 to control the film vibration, the effect is achieved even in a case where there are small cuts in the frame 14 or even in a case where there are unbonded parts.

The shapes of the frame 14 and the hole portion 12 are planar shapes. In the example shown in FIG. 1, both the shapes of the frame 14 and the hole portion 12 are squares. In the present invention, the shapes of the frame 14 and the hole portion 12 are not particularly limited. For example, the shape of each of the frame 14 and the hole portion 12 may be a quadrangle such as a rectangle, a diamond, or a parallelogram, a triangle such as an equilateral triangle, an isosceles triangle, or a right triangle, a polygon including a regular polygon such as a regular pentagon or a regular hexagon, a circle, an ellipse, and the like, or may be an irregular shape. In addition, the shape of the frame 14 and the shape of the hole portion 12 are preferably the same, but may be different.

In the example shown in FIGS. 1 and 2, end portions on both sides of the hole portion 12 of the frame 14 are not blocked, but both are opening ends so as to be opened to the outside as they are. At one opening end of the opened hole portion 12, the film 16 is fixed to the frame 14 so as to cover the hole portion 12.

At the other opening end of the opened hole portion 12, the rear member 20 is fixed to the frame 14 so as to cover the hole portion 12.

In the present invention, the end portions on both sides of the hole portion 12 of the frame 14 may be different from the example shown in FIGS. 1 and 2. That is, only one end portion of the hole portion 12 may be open to the outside, and the other end portion may be blocked by the frame 14 itself instead of providing the rear member 20. That is, the frame 14 itself may block three sides to form a rear space of the film 16. In this case, it is needless to say that the film 16 covering the hole portion 12 is fixed only to the opened one end portion of the hole portion 12.

The size of the frame 14 is the size of the square in a plan view, that is, $L_1$ in FIG. 2, and can be defined as the size of the hole portion 12. Accordingly, in the following description, it is assumed that the size of the frame 14 is the size $L_1$ of the hole portion 12. In a case where the shape of the frame 14 in a plan view is, for example, a circle or a regular polygon such as a square, the size of the frame 14 can be defined as a distance between opposite sides passing through the center of the regular polygon or as a circle equivalent diameter. In a case where the shape of the frame 14 in a plan view is, for example, a polygon, an ellipse, or an irregular shape, the size of the frame 14 can be defined as a circle equivalent diameter. In the present invention, the circle equivalent diameter and the radius are a diameter and a radius at the time of conversion into circles having the same area.

The size $L_1$ of the hole portion 12 of the frame 14 is not particularly limited, and may be set according to a soundproofing target to which the soundproof structure 10 of the present invention is applied for soundproofing. As the soundproofing target, for example, industrial equipment including various kinds of manufacturing equipment capable of emitting sound, such as a copying machine, a blower, air conditioning equipment, a ventilator, pumps, a generator, a duct, a coating machine, a rotary machine, and a conveyor machine, can be mentioned. In addition, as the soundproofing target, for example, transportation equipment, such as an automobile, a train, and aircraft, can be mentioned. In addition, as the soundproofing target, for example, general household equipment, such as a refrigerator, a washing machine, a dryer, a television, a copying machine, a microwave oven, a game machine, an air conditioner, a fan, a PC, a vacuum cleaner, and an air purifier, can be mentioned.

It is preferable that the soundproof cell 22 configured to include the frame 14 and the film 16 is smaller than the wavelength of the first natural vibration frequency of the film 16. For this reason, that is, in order to make the soundproof cell 22 smaller than the wavelength of the first natural vibration frequency, it is preferable to reduce the size $L_1$ of the frame 14.

For example, although the size $L_1$ of the hole portion 12 is not particularly limited, the size $L_1$ of the hole portion 12 is preferably 0.5 mm to 300 mm, more preferably 1 mm to 100 mm, and most preferably 10 mm to 50 mm.

As described above, the longest line segment length L of a line segment for connection of the opening end distance (that is, the distance between the end portions of the hole portion 12) of the frame 14 in the present invention is expressed by the line segment length L of the diagonal of the square of the hole portion 12 in the example shown in FIG. 1. Therefore, the line segment length L can be calculated as $L=\sqrt{2}L_1$.

The thickness $L_2$ and the width $L_3$ of the frame 14 are not particularly limited as long as the film 16 can be fixed so that the film 16 can be reliably supported. For example, the thickness $L_2$ and the width $L_3$ of the frame 14 can be set according to the size of the hole portion 12.

In addition, the thickness $L_2$ of the frame 14, that is, the thickness $L_2$ of the hole portion 12 is preferably 0.5 mm to 200 mm, more preferably 0.7 mm to 100 mm, and most preferably 1 mm to 50 mm.

For example, in a case where the size $L_1$ of the hole portion 12 is 0.5 mm to 50 mm, the width $L_3$ of the frame 14 is preferably 0.5 mm to 20 mm, more preferably 0.7 mm to 10 mm, and most preferably 1 mm to 5 mm.

In a case where the size $L_1$ of the hole portion 12 exceeds 50 mm and is equal to or less than 300 mm, the width $L_3$ of the frame 14 is preferably 1 mm to 100 mm, more preferably 3 mm to 50 mm, and most preferably 5 mm to 20 mm.

In a case where the ratio of the width $L_3$ of the frame 14 to the size $L_1$ of the frame 14 is too large, the area ratio of the frame 14 to the entire structure increases. Accordingly, there is a concern that the device (soundproof cell 22) will become heavy. On the other hand, in a case where the ratio is too small, it is difficult to strongly fix the film 16 with an adhesive or the like in the frame 14 portion.

It is preferable that the soundproof cell 22 is smaller than the wavelength of the first natural vibration frequency of the film 16. Therefore, it is preferable that the size $L_1$ of the frame 14 (hole portion 12) is a size equal to or less than the wavelength of the first natural vibration frequency of the film 16 fixed to the soundproof cell 22.

In a case where the size $L_1$ of the frame 14 (hole portion 12) of the soundproof cell 22 is a size equal to or less than the wavelength of the first natural vibration frequency of the film 16, sound pressure with low strength unevenness is applied to the film surface of the film 16. Therefore, a vibration mode of a film in which it is difficult to control sound is hard to be induced. That is, the soundproof cell 22 can acquire high sound controllability.

Applying sound pressure with less strength unevenness to the film surface of the film 16 makes the sound pressure applied to the film surface of the film 16 more uniform. Thus, in order to make the sound pressure applied to the film surface of the film 16 more uniform, assuming that the wavelength of the first natural vibration frequency of the film 16 fixed to the soundproof cell 22 is $\lambda$, the size $L_1$ of the frame 14 (hole portion 12) is preferably $\lambda/2$ or less, more preferably $\lambda/4$ or less, and most preferably $\lambda/8$ or less.

The material of the frame 14 is not particularly limited as long as the material can support the film 16, has a suitable strength in the case of being applied to the above soundproofing target, and is resistant to the soundproof environment of the soundproofing target, and can be selected according to the soundproofing target and the soundproof environment. For example, as materials of the frame 14, a resin material and an inorganic material can be mentioned. Specific examples of the resin material include acetyl cellulose based resins such as triacetyl cellulose; polyester based resins such as polyethylene terephthalate (PET) and polyethylene naphthalate; olefin based resins such as polyethylene (PE), polymethylpentene, cycloolefin polymers, and cycloolefin copolymers; acrylic based resins such as polymethyl methacrylate; and polycarbonate. In addition, resin materials, such as polyimide, polyamideide, polyarylate, polyether imide, polyacetal, polyether ether ketone, polyphenylene sulfide, polysulfone, polybutylene terephthalate, and triacetyl cellulose, can also be mentioned. In addition, carbon-fiber-reinforced plastics (CFRP), a carbon fiber, glass-fiber-reinforced plastics (GFRP), and the like can also be mentioned as resin materials.

On the other hand, as the transparent inorganic material, specifically, glass such as soda glass, potassium glass, and lead glass; ceramics such as translucent piezoelectric ceramics (PLZT: La-modified lead zirconate titanate); quartz; and fluorite can be mentioned. As materials of the frame 14, metal materials, such as aluminum and stainless steel, may be used. In addition, as materials of the frame 14, metal materials, such as titanium, magnesium, tungsten, iron, steel, chromium, chromium molybdenum, nichrome molybdenum, and alloys thereof, may be used. A plurality of kinds of these materials may also be used in combination as materials of the frame 14.

(Rear Member)

The rear member 20 closes the rear space of the film 16 surrounded by the inner peripheral surface of the frame 14.

The rear member 20 is a plate-shaped member, which faces the film 16 and is attached to the other end portion of the hole portion 12 of the frame 14, in order to make the rear space formed on the rear surface of the film 16 by the frame 14 be a closed space. Such a plate-shaped member is not particularly limited as long as a closed space can be formed on the rear surface of the film 16, and it is preferable to use a plate-shaped member formed of a material having higher stiffness than the film 16. However, the plate-shaped member may be formed of the same material as the film 16. In the case of fixing the film 16 to both side openings of the hole portion 12 of the frame 14, the protruding portion 18 may be formed on the film 16 on each of both sides, or a weight may be attached.

Here, as a material of the rear member 20, for example, the same material as the material of the frame 14 described above can be used. The method of fixing the rear member 20 to the frame 14 is not particularly limited as long as a closed space can be formed on the rear surface of the film 16, and a method similar to the above-described method of fixing the film 16 to the frame 14 may be used.

Since the rear member 20 is a plate-shaped member for making the space formed on the rear surface of the film 16 by the frame 14 be a closed space, the rear member 20 may be integrated with the frame 14 or may be integrally formed with the same material as the frame 14.

(Film)

The peripheral portion of the film 16 is fixed so as to be restrained by the frame 14 so as to cover the hole portion 12 inside the frame 14. As described above, the film 16 is for forming the high surface density region **16*a* and the low surface density region 16*b* in a state in which the protruding portion 18 is formed or a weight or the like is attached and integrated. In the film 16, the low surface density region 16*b* vibrates corresponding to acoustic waves from the outside, thereby absorbing or reflecting the energy of acoustic waves to insulate sound with the low surface density region 16*b* and the high surface density region 16*a***.

Incidentally, since the film 16 needs to vibrate with the frame 14 as a node, it is necessary for the film 16 to be fixed to the frame 14 so as to be reliably restrained by the frame 14. Then, it is necessary for the film 16 itself to form the low surface density region **16*b* to be an antinode of film vibration, so that the energy of acoustic waves is absorbed or reflected to insulate sound. For this reason, it is preferable that the film 16** is formed of a flexible elastic material.

Therefore, the shape of the film 16 is the shape of the hole portion 12 of the frame 14 shown in FIG. 1. In addition, it can be said that the size of the film 16 is the size $L_1$ of the frame 14 (hole portion 12).

As shown in FIGS. 1 and 2, in a state in which the protruding portion 18 is formed on the film 16 or a weight or the like is attached and integrated, the film 16 in which the protruding portion 18 is not formed or the film 16 in which a weight or the like is not attached is the low surface density region 16*b*. In this case, the thickness of the film 16 is the thickness of the low surface density region 16*b*.

For this reason, the thickness of the film 16 that is the thickness of the low surface density region 16*b* is not particularly limited as long as the low surface density region 16*b* adjacent to the high surface density region 16*a* can vibrate in order to insulate sound by absorbing or reflecting the energy of acoustic waves. However, it is preferable that the thickness of the film 16 is large in order to obtain the natural vibration mode on the high frequency side and small in order to obtain the natural vibration mode on the low frequency side. For example, the thickness $L_4$ of the film 16 shown in FIG. 2 is the thickness of the low surface density region 16*b*, and can be set according to the size $L_1$ of the hole portion 12, that is, the size of the film 16 in the present invention.

For example, in a case where the size $L_1$ of the hole portion 12 is 0.5 mm to 50 mm, the thickness $L_4$ of the film 16 is preferably 0.001 mm (1 μm) to 5 mm, more preferably 0.005 mm (5 μm) to 2 mm, and most preferably 0.01 mm (10 μm) to 1 mm.

In a case where the size $L_1$ of the hole portion 12 exceeds 50 mm and is equal to or less than 300 mm, the thickness $L_4$ of the film 16 is preferably 0.01 mm (10 μm) to 20 mm, more preferably 0.02 mm (20 μm) to 10 mm, and most preferably 0.05 mm (50 μm) to 5 mm.

It is preferable that the thickness of the film 16 is expressed by an average thickness, for example, in a case where there are different thicknesses in one film 16. In the case of the thickness of the film 16 forming the low surface density region 16*b* where the protruding portion 18 is not formed or the low surface density region 16*b* where a weight is not attached, the average thickness is an average thickness h of the low surface density region 16*b*.

As described above, the film 16 in which the protruding portion 18 is not formed or the film 16 in which a weight or the like is not attached is the low surface density region 16*b*. For this reason, the Young's modulus of the film 16 is the Young's modulus of the low surface density region 16*b*.

Therefore, the Young's modulus of the film 16 that is the Young's modulus of the low surface density region 16*b* is not particularly limited as long as there is an elasticity that can cause vibration of the low surface density region 16*b* adjacent to the high surface density region 16*a* in order to insulate sound by absorbing or reflecting the energy of acoustic waves. It is preferable that the Young's modulus of the film 16 is large in order to obtain the natural vibration mode on the high frequency side and small in order to obtain the natural vibration mode on the low frequency side. In the present invention, the Young's modulus of the film 16 can be set according to the size of the frame 14 (hole portion 12) (that is, the size of the film) $L_1$, for example.

For example, the Young's modulus of the film 16 alone is preferably 1000 Pa to 3000 GPa, more preferably 10000 Pa to 2000 GPa, and most preferably 1 MPa to 1000 GPa.

As described above, since the film 16 in which the protruding portion 18 is not formed or the film 16 in which a weight or the like is not attached is the low surface density region 16*b*, the density of the film 16 is also the density of the low surface density region 16*b*.

For this reason, the density of the film 16 that is the density of the low surface density region 16*b* is not particularly limited as long as the low surface density region 16*b* adjacent to the high surface density region 16*a* can vibrate in order to insulate sound by absorbing or reflecting the energy of acoustic waves. For example, the density of the film 16 is preferably 5 kg/m$^3$ to 30000 kg/m$^3$, more preferably 10 kg/m$^3$ to 20000 kg/m$^3$, and most preferably 100 kg/m$^3$ to 10000 kg/m$^3$.

In a case where a film-shaped material or a foil-shaped material is used as a material of the film 16, the material of the film 16 needs to have a suitable strength in the case of being applied to the above-described soundproofing target and is resistant to the soundproof environment of the soundproofing target. In addition, the material of the film 16 needs to be able to vibrate so that the film 16 insulates sound by absorbing or reflecting the energy of acoustic waves. The material of the film 16 is not particularly limited as long as the material has the features described above, and can be selected according to the soundproofing target, the soundproof environment, and the like.

As examples of the material of the film 16, resin materials that can be made into a film shape, such as polyethylene terephthalate (PET), polyimide, polymethylmethacrylate, polycarbonate, acrylic (polymenthyl methacrylate: PMMA), polyamideide, polyarylate, polyetherimide, polyacetal, polyetheretherketone, polyphenylene sulfide, polysulfone, polybutylene terephthalate, triacetyl cellulose, polyvinylidene chloride, low density polyethylene, high density polyethylene, aromatic polyamide, silicone resin, ethylene ethyl acrylate, vinyl acetate copolymer, polyethylene, chlorinated polyethylene, polyvinyl chloride, polymethyl pentene, and polybutene, can be mentioned. In addition, metal materials that can be made into a foil shape, such as aluminum, chromium, titanium, stainless steel, nickel, tin, niobium, tantalum, molybdenum, zirconium, gold, silver, platinum, palladium, iron, copper, and permalloy, can also be mentioned. In addition, materials that can form a thin structure, such as paper, materials that become other fibrous films such as cellulose, nonwoven fabrics, films containing nano-sized fibers, thinly processed urethane, porous materials such as thinsulate, and carbon materials processed into a thin film structure, can be mentioned.

In addition, the film 16 is fixed to the frame 14 so as to cover an opening on at least one side of the hole portion 12 of the frame 14. That is, the film 16 may be fixed to the frame 14 so as to cover openings on one side, the other side, or both sides of the hole portion 12 of the frame 14.

The method of fixing the film 16 to the frame 14 is not particularly limited, and any method may be used as long as the film 16 can be fixed to the frame 14 so as to serve as a node of film vibration. As the method of fixing the film 16 to the frame 14, for example, a method using an adhesive and a method using a physical fixture can be mentioned.

In the method of using an adhesive, an adhesive is applied onto the surface of the frame 14 surrounding the hole portion 12 and the film 16 is placed thereon, so that the film 16 is fixed to the frame 14 with the adhesive. Examples of the adhesive include epoxy-based adhesives (Araldite (registered trademark) (manufactured by Nichiban Co., Ltd.) and the like), cyanoacrylate-based adhesives (Aron Alpha (registered trademark) (manufactured by Toagosei Co., Ltd.) and the like), and acrylic-based adhesives.

As a method using a physical fixture, a method can be mentioned in which the film 16 disposed so as to cover the hole portion 12 of the frame 14 is interposed between the frame 14 and a fixing member, such as a rod, and the fixing member is fixed to the frame 14 by using a fixture, such as a screw or a small screw.

Although the soundproof cell 22 of Embodiment 1 has a structure in which the frame 14 and the film 16 are formed as separate bodies and the film 16 is fixed to the frame 14, the present invention is not limited thereto, and a structure in which the film 16 and the frame 14 formed of the same material are integrated may be adopted.

Here, the film 16 that is fixed to the frame 14 of the soundproof cell 22 and comprises the protruding portion 18 or the weight has a first natural vibration frequency, which is the frequency of the lowest order natural vibration mode that can be induced in the structure of the soundproof cell 22. For example, the first natural vibration frequency that is the frequency of the lowest order natural vibration mode is a resonance frequency having a lowest order absorption peak at which the transmission loss of the film is minimized with respect to the acoustic wave incident approximately perpendicular to the film 16 that is fixed to the frame 14 of the soundproof cell 22 and comprises the protruding portion 18 or the weight. That is, in the present invention, at the first natural vibration frequency of the film 16, sound is transmitted and an absorption peak of the lowest order frequency is obtained. In the present invention, the resonance frequency is determined by the soundproof cell 22 including the frame 14 and the film 16 that comprises the protruding portion 18 or the weight.

That is, the resonance frequency in the structure including the frame 14 and the film 16 that comprises the protruding portion 18 or the weight, that is, the resonance frequency of the film 16 fixed so as to be restrained by the frame 14 is a frequency at which acoustic waves cause film vibration most. Acoustic waves are largely transmitted at the resonance frequency, and the resonance frequency is a frequency of the natural vibration mode having an absorption peak of the lowest order frequency.

In the present invention, the first natural vibration frequency is determined by the soundproof cell 22 including the frame 14 and the film 16 that comprises the protruding portion 18 or the weight. In the present invention, the first natural vibration frequency determined in this manner is referred to as a first natural vibration frequency of a film. For example, a boundary between a frequency region according to the stiffness law and a frequency region according to the mass law becomes the lowest order first resonance frequency.

The first natural vibration frequency of the film 16 that is fixed to the frame 14 and comprises the protruding portion 18 or the weight is preferably 100000 Hz or less, more preferably 20000 Hz or less.

Specifically, the first natural vibration frequency of the film 16 described above is preferably 100000 Hz or less corresponding to the upper limit of the acoustic wave sensing range of a human being, more preferably 20000 Hz or less corresponding to the upper limit of the audible range of acoustic waves of a human being, even more preferably 15000 Hz or less, most preferably 10000 Hz or less. The lower limit of the first natural vibration frequency is preferably 5 Hz or more in a case where the sound absorption peak is obtained in the audible range by using the present invention.

Here, in the soundproof cell 22 of the present embodiment, the resonance frequency of the film 16 in the structure including the frame 14 and the film 16 that comprises the protruding portion 18 or the weight, for example, the first natural vibration frequency can be determined by the geometric form of the frame 14 of the soundproof cell 22 (for example, the shape and dimension (size) of the frame 14), the stiffness of the film 16 comprising the protruding portion 18 or the weight of the soundproof cell 22 (for example, the thickness and flexibility of the film 16 comprising the protruding portion 18 or the weight), and the volume of the space behind the film.

(Protruding Portion)

Incidentally, in the present invention, in the example shown in FIGS. 1 and 2, the protruding portion 18 is formed or a weight is attached on the inner side (frame 14 side) of the film 16, the region of the film 16 having the protruding portion 18 or the weight forms the high surface density region 16*a* of the film. That is, for the surface density of the film, it is possible to realize the high surface density region 16*a* of the film by providing the protruding portion 18 in the film 16 or attaching a weight to the film 16.

The protruding portion 18 or the weight is for forming the high surface density region 16*a* of the film in the film 16. The protruding portion 18 or the weight is not particularly limited as long as it is possible to form the high surface density region 16*a* of the film in the film 16.

The shape of the protruding portion 18 is a square in the example shown in FIG. 1. In the present invention, the shape of the protruding portion 18 or the weight is not particularly limited. For example, the shape of the protruding portion 18 or the weight may be a quadrangle such as a rectangle, a diamond, or a parallelogram, a triangle such as an equilateral triangle, an isosceles triangle, or a right triangle, a polygon including a regular polygon such as a regular pentagon or a regular hexagon, a circle, an ellipse, and the like, or may be an irregular shape.

The material of the protruding portion 18 or the weight is not particularly limited, and may be the same material as the film 16 or may be a material different from the material of the film 16. In addition, as a material of the protruding portion 18 or the weight, the same material as the material of the film 16 or the material of the frame 14 can be used. The material of the weight is not particularly limited, but a material heavier than the material of the film 16 is preferable.

The protruding portion 18 or the weight may be integrated with the film 16, or may be formed as separate bodies and attached to the film 16.

That is, the protruding portion 18 of the film 16 may be molded integrally with the film 16 using a molding technique, such as resin molding or imprinting. That is, the film 16 having the protruding portion 18 is preferably a resin film having unevenness. Alternatively, in the same manner as in the case of attaching a weight to the film 16, the protruding portion 18 of the film 16 may be fixed later on the film 16 using any known method, for example, a tape or an adhesive. In the case of fixing the protruding portion 18 or the weight to the film 16, the fixing is performed using the same method as the above method of fixing the film 16 to the frame 14.

Alternatively, the frame 14 and the film 16 or the frame 14, the film 16, and the protruding portion 18 or the weight can be molded together using a 3D printer or the like, or only the protruding portion 18 or the weight can be applied later to the film 16 molded together with frame 14.

In the example shown in FIGS. 1 and 2, the film 16 comprises a plurality of (for example, 5×5 (=25)) protruding portions 18, but the present invention is not limited thereto. As in a soundproof structure 10A having a soundproof cell 22A shown in FIGS. 3 and 4, one protruding portion 18 or one weight may be provided.

In the example shown in FIGS. 1 and 2, the film 16 comprises a plurality of (for example, 25) protruding portions 18 having the same shape, the same size, and the same height, but the present invention is not limited thereto. The film 16 may have a plurality of protruding portions 18 that differ in at least one of the shape, the size, or the height, or may have weights that differ in at least one of the shape, the size, the height, or the weight.

In the example shown in FIGS. 1 and 2, a plurality of (for example, 25) protruding portions 18 are regularly arranged on the film 16, but the present invention is not limited thereto. In a form in which the protruding portion 18 or the weight is provided on the film 16 as in a soundproof structure 10B having a soundproof cell 22B shown in FIGS. 5 and 6, the protruding portion 18 or the weight does not need to be regularly arranged on the film 16, and a plurality of (for example, 25) protruding portions 18 or weights may be randomly disposed on the film 16.

In the example shown in FIGS. 1 and 2, the film 16 comprises a plurality of (for example, 25) protruding portions 18, but the present invention is not limited thereto. Instead of providing the protruding portion 18 on the film 16, a recessed portion may be provided to form the low surface density region 16*b*, and a portion of the film 16 in which the recessed portion is not provided may be used as the high surface density region 16*a*. Alternatively, the low surface density region 16*b* may be formed by making a cut in the film 16 or the recessed portion of the film 16 (as a result, bending stiffness is reduced) and realizing low bending stiffness. For example, the low surface density region 16*b* can also be formed by making a cut in a lattice form to lower the bending stiffness more isotropically.

In the example shown in FIGS. 1 and 2, the film 16 is provided on one side of the opening of the hole portion 12 of the frame 14, and the protruding portion 18 is formed on the inner side (frame 14 side) of the film 16. However, the present invention is not limited thereto. The film 16 may be provided on both sides of the opening of the hole portion 12 of the frame 14. The protruding portion 18, the recessed portion, or the weight may be on any side of the inner side (frame 14 side) and the outer side (side opposite to the frame 14) of the film 16.

Figure 7:
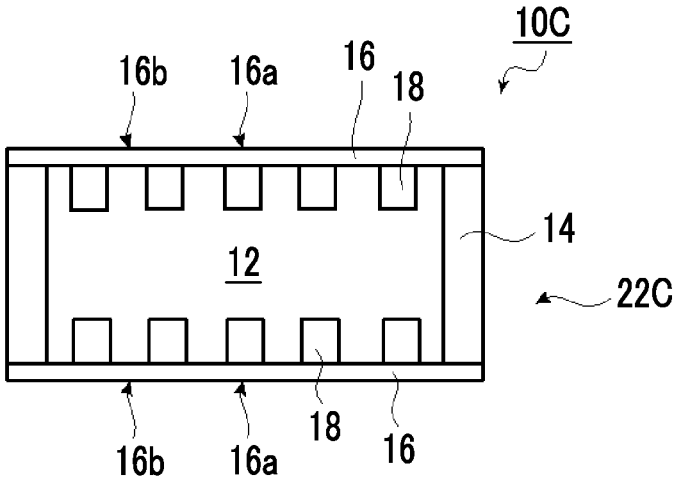
FIG. 7 is a schematic cross-sectional view of another example of the soundproof structure according to the present invention.

For example, as in a soundproof structure 10C having a soundproof cell 22C shown in FIG. 7, the film 16 may be provided on both sides of the opening of the hole portion 12 of the frame 14, and the protruding portion 18, a recessed portion, or a weight may be provided on the inner sides (frame 14 sides) of the films 16 on both the sides.

Figure 8:
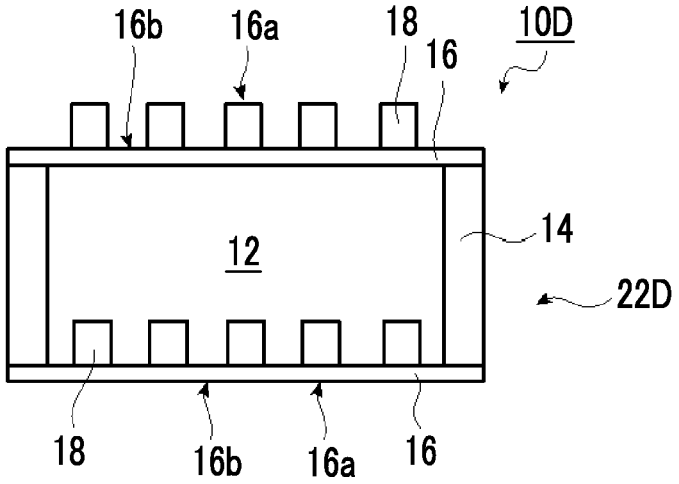
FIG. 8 is a schematic cross-sectional view of another example of the soundproof structure according to the present invention.

For example, as in a soundproof structure 10D having a soundproof cell 22D shown in FIG. 8, the film 16 may be provided on both sides of the opening of the hole portion 12 of the frame 14, the protruding portion 18, a recessed portion, or a weight may be provided on the outer side (side opposite to the frame 14) of one film 16 of the films 16 on both the sides, and the protruding portion 18, a recessed portion, or a weight may be provided on the inner side (frame 14 side) of the other film 16.

Figure 9:
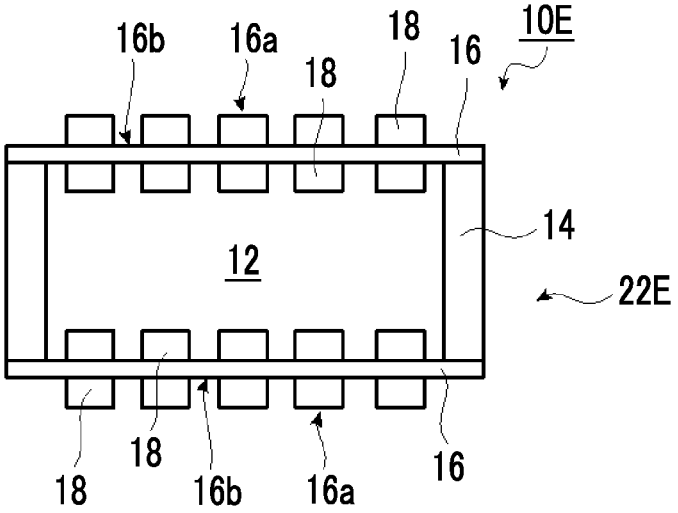
FIG. 9 is a schematic cross-sectional view of another example of the soundproof structure according to the present invention.

For example, as in a soundproof structure 10E having a soundproof cell 22E shown in FIG. 9, the film 16 may be provided on both sides of the opening of the hole portion 12 of the frame 14, and the protruding portion 18, a recessed portion, or a weight may be provided on both the inner and outer sides (frame 14 side and the opposite side) of each film 16 of the films 16 on both the sides.

However, in a case where the protruding portion 18 of the film 16 is present on the side of the frame 14, the volume of the rear air layer surrounded by the frame 14 and the film 16 is reduced in a case where the volume of the protruding portion 18 of the film 16 is large. As a result, the effect of the rear air layer changes and the peak frequency increases, so that the targeted low frequency peak may not be obtained. In a case where such an adverse effect occurs, it is preferable to provide the protruding portion 18 of the film 16 on a side opposite to the frame 14.

In the example shown in FIGS. 1 and 2, the film 16 of one layer is provided on one side of the opening of the hole portion 12 of the frame 14, and the protruding portion 18 is formed on the inner side (frame 14 side) of the film 16. However, the present invention is not limited thereto.

Figure 10:
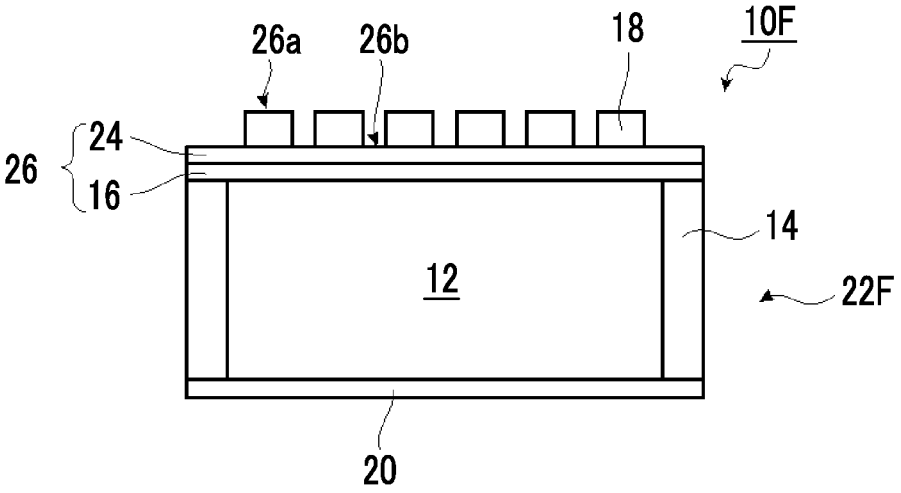
FIG. 10 is a schematic cross-sectional view of another example of the soundproof structure according to the present invention.

For example, as in a soundproof structure 10F having a soundproof cell 22F shown in FIG. 10, a laminated film 26 of two layers configured to include films 16 and 24 may be provided on one side of the opening of the hole portion 12 of the frame 14, and the protruding portion 18, a recessed portion, or a weight may be provided on the outer side (side opposite to the frame 14) of the laminated film 26. In the soundproof cell 22F, a region of the laminated film 26 in which the protruding portion 18, the recessed portion, or the weight is attached is a high surface density region 26*a*, and a region of the laminated film 26 itself in which the protruding portion 18, the recessed portion, or the weight is not attached is a low surface density region 26*b*.

In a case where two kinds of film materials of the film 16 and the film 24 of the two-layer laminated film 26 are used, the material of the low surface density region 26*b* includes the two kinds of film materials of the film 16 and the film 24. As described above, in a case where the low surface density region 26*b* is formed of two kinds of materials, the parameter X of the film can be defined as the following Equation (3). Therefore, in this case, the following Equation (3) may be used instead of the above Equation (1).

$$X=(E_1h_1^2+E_2h_2^2)/(\rho max/\rho min)[N] \quad (3)$$

Here, $E_1$ and $E_2$ are Young's moduli of two kinds of film materials of the film 16 and the film 24 forming the low surface density region 26*b*, and $h_1$ and $h_2$ are average film thicknesses of the film 16 and the film 24 forming the low surface density region 26*b*.

Similarly, in a case where the low surface density region has a laminated structure, the parameter X of the film can be defined as the following Equation (4). Therefore, in this case, the following Equation (4) may be used instead of the above Equation (1).

$$X=\Sigma(E_ih_i^2)/(\rho max/\rho min)[N] \quad (4)$$

Here, $E_i$ is the Young's modulus of the film material of the i-th film from the side of the frame 14 of the laminated film 26 forming the low surface density region 26*b*, and $h_i$ is the average film thickness of the i-th film from the side of the frame 14 of the laminated film 26 forming the low surface density region 26*b*.

The soundproof structures 10, 10A, 10B, 10C, 10D, 10E, and 10F shown in FIGS. 1 to 10 have one soundproof cells 22, 22A, 22B, 22C, 22D, 22E, and 22F, respectively. However, the present invention is not limited thereto, and may have a plurality of soundproof cells.

In a soundproof structure having a plurality of soundproof cells, the same type of soundproof cells of the present invention may be used, or different types of the plurality of soundproof cells of the present invention may be used. The soundproof structure having the plurality of soundproof cells may further include one or more kinds of soundproof cells based on the related art.

At this time, the plurality of frames 14 of the plurality of soundproof cells of the soundproof structure may be formed as one frame body. The plurality of films 16 of the plurality of soundproof cells of the soundproof structure may be formed as one sheet-shaped film body.

The soundproof structures 10 and 10A to 10F and the soundproof cells 22 and 22A to 22F of the present invention are basically formed as described above.

The soundproof structure of the present invention may have a structure in which one or more soundproof cells, such as the soundproof cells 22 and 22A to 22F of the present invention described above, are disposed within an opening member having an opening, such as a duct. In this case, it is preferable that the soundproof cell is disposed in the opening member in a state in which the film surface of the film is inclined with respect to the opening cross section of the opening member and a region serving as a ventilation hole through which gas passes is provided in the opening member.

Figure 11:
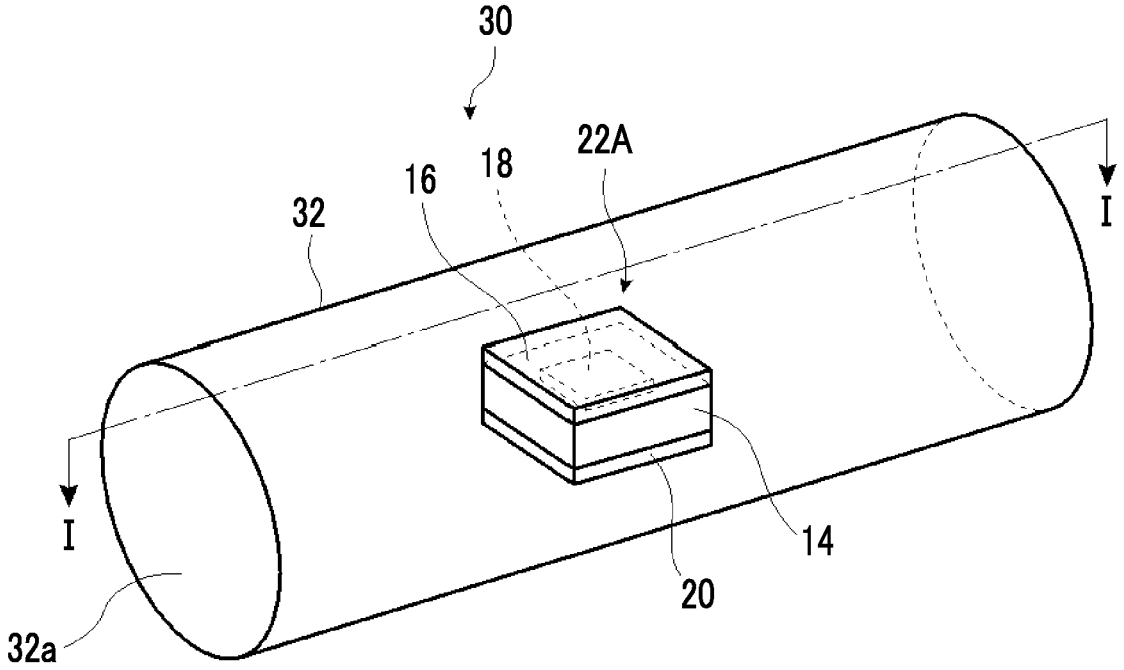
FIG. 11 is a schematic perspective view of an example of a soundproof structure according to another embodiment of the present invention.
Figure 12:
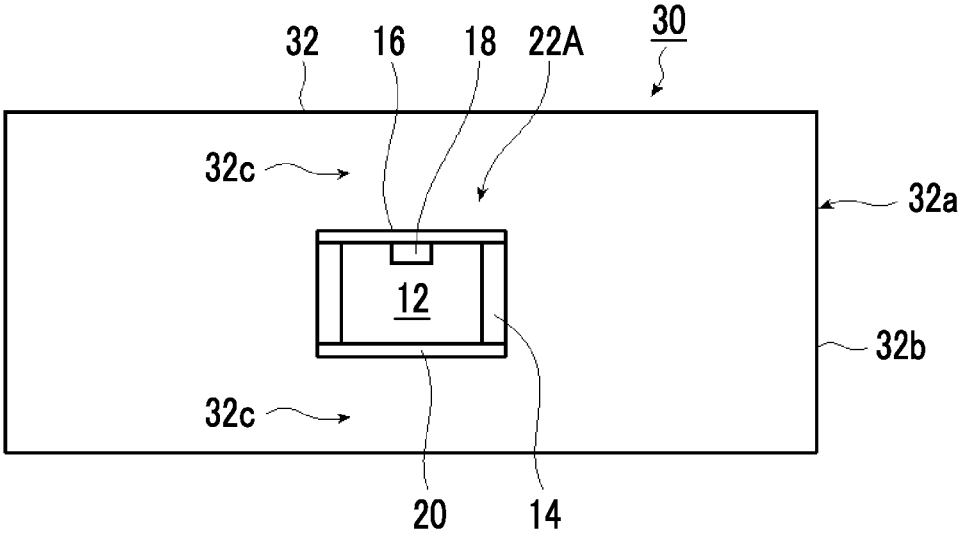
FIG. 12 is a schematic cross-sectional view of the soundproof structure shown in FIG. 11 taken along the line I-I.

FIG. 11 is a perspective view schematically showing an example of a soundproof structure according to another embodiment of the present invention. FIG. 12 is a schematic cross-sectional view of the soundproof structure shown in FIG. 11 taken along the line I-I.

Figure 3:
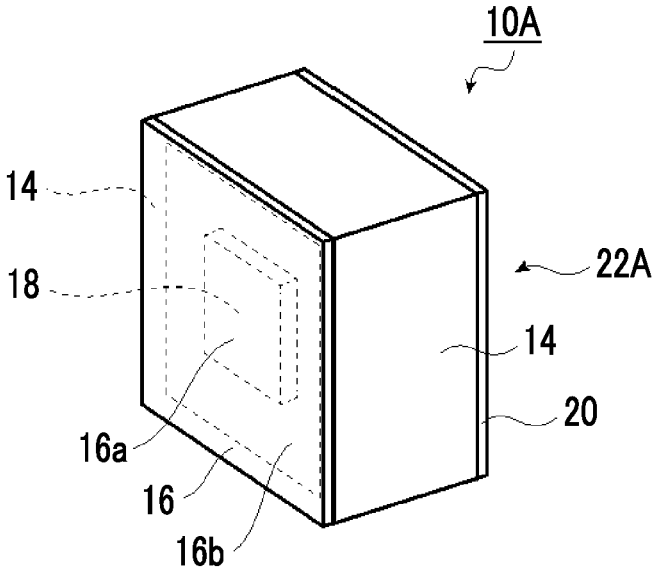
FIG. 3 is a schematic perspective view of another example of the soundproof structure according to the present invention.

A soundproof structure 30 of the present embodiment shown in FIGS. 11 and 12 has a structure in which the soundproof cell 22A of the soundproof structure 10A shown in FIG. 3 is disposed in a tubular body 32 (opening 32*a* thereof) formed of aluminum that is an opening member of the present embodiment. The soundproof cell 22 is disposed in the tubular body 32 in a state in which the film surface of the film 16 is inclined by 90° with respect to the opening cross section 32*b* and a region serving as a ventilation hole 32*c* through which gas passes is provided in the opening 32*a* in the tubular body 32. That is, the soundproof cell 10A is disposed in parallel with the center line of the tubular body 32.

Although the tubular body 32 is an opening member formed in a region of an object that blocks the passage of gas herein, the tube wall of the tubular body 32 forms a wall of an object that blocks the passage of gas, for example, a wall of an object separating two spaces from each other, and the inside of the tubular body 32 forms the opening 32*a* formed in a region of a part of the object that blocks the passage of gas.

In the present embodiment, it is preferable that the opening member has an opening formed in the region of the object that blocks the passage of gas, and it is preferable that the opening member is provided in a wall separating two spaces from each other.

Here, the object that has a region where an opening is formed and that blocks the passage of gas refers to a member, a wall, and the like separating two spaces from each other. The member refers to a member, such as a tubular body and a cylindrical body. The wall refers to, for example, a fixed wall forming a building structure such as a house, a building, and a factory, a fixed wall such as a fixed partition disposed in a room of a building to partition the inside of the room, or a movable wall such as a movable partition disposed in a room of a building to partition the inside of the room.

The opening member of the present embodiment may be a tubular body or a cylindrical body, such as a duct, or may be a wall itself having an opening for attaching a ventilation hole, such as a louver or a gully, or a window, or may be a mounting frame, such as a window frame attached to a wall.

The shape of the opening of the opening member of the present embodiment is a cross-sectional shape, which is a circle in the illustrated example. In the present invention, however, the shape of the opening of the opening member is not particularly limited as long as a soundproof cell or a soundproof cell unit configured to include a plurality of soundproof cells can be disposed in the opening. For example, the shape of the opening of the opening member may be a quadrangle such as a square, a rectangle, a diamond, or a parallelogram, a triangle such as an equilateral triangle, an isosceles triangle, or a right triangle, a polygon including a regular polygon such as a regular pentagon or a regular hexagon, an ellipse, and the like, or may be an irregular shape.

Materials of the opening member of the present embodiment are not particularly limited, and metal materials such as aluminum, titanium, magnesium, tungsten, iron, steel, chromium, chromium molybdenum, nichrome molybdenum, and alloys thereof, resin materials such as acrylic resins, polymethyl methacrylate, polycarbonate, polyamideide, polyarylate, polyether imide, polyacetal, polyether ether ketone, polyphenylene sulfide, polysulfone, polyethylene terephthalate, polybutylene terephthalate, polyimide, and triacetyl cellulose, carbon fiber reinforced plastics (CFRP), carbon fiber, glass fiber reinforced plastics (GFRP), and wall materials such as concrete similar to the wall material of buildings and mortar can be mentioned.

Figure 13:
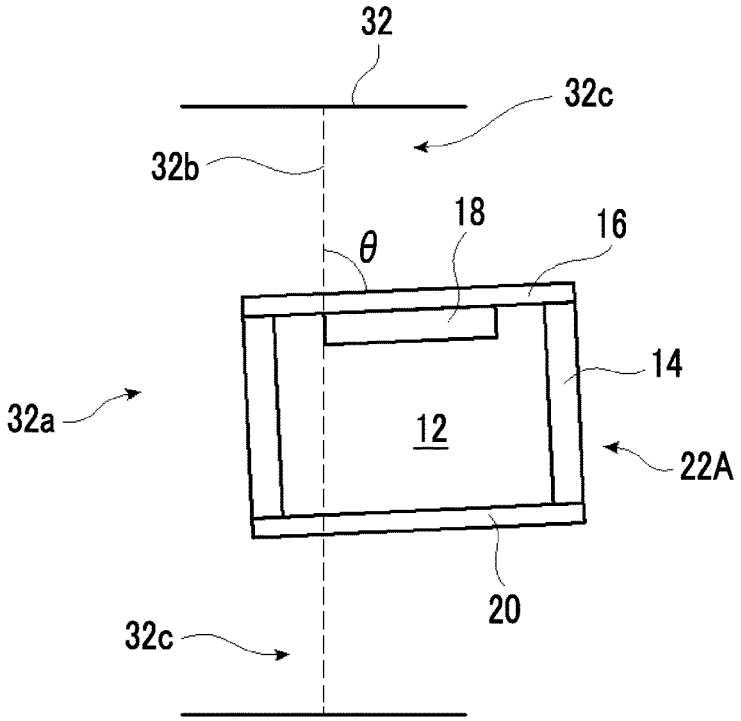
FIG. 13 is an explanatory diagram illustrating the inclination angle of a film surface of a soundproof cell with respect to an opening cross section of an opening member of the soundproof structure of the present invention.

In the soundproof structure 30 shown in FIGS. 11 and 12, one soundproof cell 22A is disposed in the tubular body 32 in a state in which the film surface of the film 16 is inclined by 90° with respect to the opening cross section 32*b*. However, the present invention is not limited thereto. For example, in the soundproof structure of the present embodiment, a plurality of soundproof cells may be disposed in the tubular body 32 as a soundproof cell unit. In the soundproof structure of the present embodiment, instead of the soundproof cell 22A, other forms of soundproof cells such as the soundproof cells 22, 22B, 22C, 22D, 22E, and 22F of the soundproof structures 10, 10B, 10C, 10D, 10E, and 10F may be disposed in the tubular body 32. In the soundproof structure of the present embodiment, as long as a region serving as a ventilation hole through which gas passes can be provided in the opening 32*a* in the tubular body 32, the film surface of the film 16 of the soundproof cell 22A may be parallel to the opening cross section 32*b* of the tubular body 32. Alternatively, as shown in FIG. 13, the soundproof cell 22A may be disposed in a state in which the film surface of the film 16 of the soundproof cell 22A is inclined by a predetermined angle θ with respect to the opening cross section 32*b* of the tubular body 32 and the ventilation hole 32*c* through which gas passes is provided in the opening 32*a* in the tubular body 32.

In the present embodiment, the inclination angle θ is preferably 20° or more, more preferably 45° or more, and even more preferably 80° or more, from the viewpoint of air permeability.

Here, the reason why the inclination angle θ is preferably 20° or more is that, in a case where the device cross section (film surface of the film 16) of the soundproof cell 22A is equal to the opening cross section 32*b*, it is possible to obtain a preferable opening ratio of 10% or more by setting the inclination angle θ to 20° or more.

In a case where the inclination angle θ is 20° to 45°, a sound insulation peak of the first vibration mode of the low frequency is present and the sound insulation performance of 10% or more can be maintained with respect to the maximum sound insulation (θ=0°), which is preferable.

The reason why the inclination angle θ is preferably 45° or more is that the angle of the standard sash or gully considering ventilation is about 45°.

The reason why the inclination angle θ is more preferably 80° or more is that the influence of constant pressure applied to the film 16 by the wind can be minimized and a change in soundproofing characteristics can be suppressed even in a case where the wind speed increases. In a case where the inclination angle θ is 80° or more, a reduction in the wind speed is eliminated, and a state with the highest ventilation capability is obtained.

The opening ratio of the soundproof structure of the present embodiment is defined by the following Equation (5). In the soundproof structure 10A of Embodiment 2, the opening ratio defined by the following Equation (5) is about 67%. Accordingly, it is possible to obtain high air permeability or ventilation.

$$\text{Opening ratio (\%)}=\{1-(\text{cross-sectional area of soundproof cell in opening cross section}/\text{cross-sectional area of opening})\}\times 100 \quad (5)$$

In the soundproof structure of the present embodiment, as shown in FIG. 13, the soundproof cell 22A is disposed in the tubular body 32, which is an opening member, so that the film surface of the film 16 is inclined by a predetermined inclination angle θ with respect to the opening cross section 32*b* of the tubular body 32. A gap formed between the film surface of the film 16 of the inclined soundproof cell 18 shown in FIG. 13 and the tube wall of the tubular body 32 serves as the ventilation hole 32*c*, through which gas can pass, formed in the opening 32*a* of the tubular body 32.

In the present embodiment, the opening ratio of the ventilation hole 32*c* is preferably 10% or more, more preferably 25% or more, and even more preferably 50% or more.

Here, the reason why the opening ratio of the ventilation hole 32*c* is preferably 10% or more is that the opening ratio of a commercially available air-permeable soundproof member (AirTooth (registered trademark)) is about 6%, but the soundproof structure of the present embodiment can exhibit high soundproofing performance even with the opening ratio of 2 digits or more which has not been conventionally possible (in a commercially available product).

In addition, the reason why the opening ratio of the ventilation hole 32*c* is preferably 25% or more is that the soundproof structure of the present embodiment can exhibit high soundproofing performance even with the opening ratio of 25% to 30% of standard sash and gully.

In addition, the reason why the opening ratio of the ventilation hole 32*c* is preferably 50% or more is that the soundproof structure of the present embodiment can exhibit high soundproofing performance even with the opening ratio of 50% to 80% of highly air-permeable sash and gully.

Hereinafter, the physical properties or characteristics of a structural member that can be combined with a soundproof structure having the soundproof structure of the present invention will be described.

[Flame Retardance]

In the case of using a soundproof structure having the soundproof structure of the present invention as a soundproof material in a building or a device, flame retardance is required.

Therefore, the film is preferably flame retardant. As the film, for example, Lumirror (registered trademark) nonhalogen flame-retardant type ZV series (manufactured by Toray Industries, Inc.) that is a flame-retardant PET film, Teijin Tetoron (registered trademark) UF (manufactured by Teijin Ltd.), and/or Dialamy (registered trademark) (manufactured by Mitsubishi Plastics Co., Ltd.) that is a flame-retardant polyester film may be used.

The frame is also preferably a flame-retardant material. A metal such as aluminum, an inorganic material such as ceramic, a glass material, flame-retardant polycarbonate (for example, PCMUPY 610 (manufactured by Takiron Co., Ltd.)), and/or flame-retardant plastics such as flame-retardant acrylic (for example, Acrylite (registered trademark) FR1 (manufactured by Mitsubishi Rayon Co., Ltd.)) can be mentioned.

As a method of fixing the film to the frame, a bonding method using a flame-retardant adhesive (Three Bond 1537 series (manufactured by Three Bond Co. Ltd.)) or solder or a mechanical fixing method, such as interposing a film between two frames so as to be fixed therebetween, is preferable.

[Heat Resistance]

There is a concern that the soundproofing characteristics may be changed due to the expansion and contraction of the structural member of the soundproof structure of the present invention due to an environmental temperature change. Therefore, the material forming the structural member is preferably a heat resistant material, particularly a material having low heat shrinkage.

As the film, for example, Teijin Tetoron (registered trademark) film SLA (manufactured by Teijin DuPont), PEN film Teonex (registered trademark) (manufactured by Teijin DuPont), and/or Lumirror (registered trademark) off-anneal low shrinkage type (manufactured by Toray Industries, Inc.) are preferably used. In general, it is preferable to use a metal film, such as aluminum having a smaller thermal expansion factor than a plastic material.

As the frame, it is preferable to use heat resistant plastics, such as polyimide resin (TECASINT 4111 (manufactured by Enzinger Japan Co., Ltd.)) and/or glass fiber reinforced resin (TECAPEEKGF 30 (manufactured by Enzinger Japan Co., Ltd.)) and/or to use a metal such as aluminum, an inorganic material such as ceramic, or a glass material.

As the adhesive, it is preferable to use a heat resistant adhesive (TB 3732 (manufactured by Three Bond Co., Ltd.), super heat resistant one component shrinkable RTV silicone adhesive sealing material (manufactured by Momentive Performance Materials Japan Ltd.) and/or heat resistant inorganic adhesive Aron Ceramic (registered trademark) (manufactured by Toagosei Co., Ltd.)). In the case of applying these adhesives to a film or a frame, it is preferable to set the thickness to 1 μm or less so that the amount of expansion and contraction can be reduced.

[Weather Resistance and Light Resistance]

In a case where the soundproof structure having the soundproof structure of the present invention is disposed outdoors or in a place where light is incident, the weather resistance of the structural member becomes a problem.

Therefore, as a film, it is preferable to use a weather-resistant film, such as a special polyolefin film (ARTPLY (registered trademark) (manufactured by Mitsubishi Plastics Inc.)), an acrylic resin film (ACRYPRENE (manufactured by Mitsubishi Rayon Co.)), and/or Scotch Calfilm (trademark) (manufactured by 3M Co.).

As a frame material, it is preferable to use plastics having high weather resistance such as polyvinyl chloride, polymethyl methacryl (acryl), metal such as aluminum, inorganic materials such as ceramics, and/or glass materials.

As an adhesive, it is preferable to use epoxy resin based adhesives and/or highly weather-resistant adhesives such as Dry Flex (manufactured by Repair Care International).

Regarding moisture resistance as well, it is preferable to appropriately select a film, a frame, and an adhesive having high moisture resistance. Regarding water absorption and chemical resistance, it is preferable to appropriately select an appropriate film, frame, and adhesive.

[Dust]

During long-term use, dust may adhere to the film surface to affect the soundproofing characteristics of the soundproof structure of the present invention. Therefore, it is preferable to prevent the adhesion of dust or to remove adhering dust.

As a method of preventing dust, it is preferable to use a film formed of a material to which dust is hard to adhere. For example, by using a conductive film (Flecria (registered trademark) (manufactured by TDK Corporation) and/or NCF (manufactured by Nagaoka Sangyou Co., Ltd.)) so that the film is not charged, it is possible to prevent adhesion of dust due to charging. It is also possible to suppress the adhesion of dust by using a fluororesin film (Dynoch Film (trademark) (manufactured by 3M Co.)), and/or a hydrophilic film (Miraclain (manufactured by Lifegard Co.)), RIVEX (manufactured by Riken Technology Inc.) and/or SH2CLHF (manufactured by 3M Co.). By using a photocatalytic film (Raceline (manufactured by Kimoto Corporation)), contamination of the film can also be prevented. A similar effect can also be obtained by applying a spray having the conductivity, hydrophilic property and/or photocatalytic property and/or a spray containing a fluorine compound to the film.

In addition to using the above special films, it is also possible to prevent contamination by providing a cover on the film. As the cover, it is possible to use a thin film material (Saran Wrap (registered trademark) or the like), a mesh having a mesh size not allowing dust to pass therethrough, a nonwoven fabric, a urethane, an airgel, a porous film, and the like.

As a method of removing adhering dust, it is possible to remove dust by emitting sound having the resonance frequency of a film and strongly vibrating the film. The same effect can be obtained even in a case where a blower or wiping is used.

[Wind Pressure]

In a case where a strong wind hits a film, the film may be pressed to change the resonance frequency. Therefore, by covering the film with a nonwoven fabric, urethane, and/or a film, the influence of wind can be suppressed.

In the soundproof structure of the present invention, in order to suppress the influence (wind pressure on the film, wind noise) due to turbulence caused by blocking the wind on the side surface of the soundproof structure, it is preferable to provide a flow control mechanism, such as a flow straightening plate for rectifying wind W, on the side surface of the soundproof structure.

[Combination of Unit Cells]

The soundproof structures 10 and 10A to 10F of the present invention shown in FIGS. 1 to 10 are configured to include one soundproof cells 22 and 22A to 22F as unit cells each having one frame 14, one film 16 attached thereto, and the protruding portion 18, a weight, or a recessed portion provided in the film 16. On the other hand, the soundproof structure of the present invention is configured to include a plurality of soundproof cells integrated in advance that include one frame body in which a plurality of frames are continuous, a sheet-shaped film body in which a plurality of films attached to hole portions of the plurality of frames of the one frame body are continuous, and the protruding portions 18, weights, or recessed portions provided in the plurality of films. Thus, the soundproof structure of the present invention may be a soundproof structure in which a unit cell is used independently, or may be a soundproof structure in which a plurality of soundproof cells are integrated in advance, or may be a soundproof structure including a plurality of soundproof cells used by connecting a plurality of unit cells to each other.

As a method of connecting a plurality of unit cells to each other, a Magic Tape (registered trademark), a magnet, a button, a suction cup, and/or an uneven portion may be attached to a frame so as to be combined therewith, or a plurality of unit cells can be connected to each other using a tape or the like.

[Arrangement]

In order to allow the soundproof structure having the soundproof structure of the present invention to be easily attached to a wall or the like or to be removable therefrom, a detaching mechanism formed of a magnetic material, a Magic Tape (registered trademark), a button, a suction cup, or the like is preferably attached to the soundproof structure.

[Mechanical Strength of Frame]

As the size of the soundproof structure having the soundproof structure of the present invention increases, the frame easily vibrates, and a function as a fixed end with respect to film vibration is degraded. Therefore, it is preferable to increase the frame stiffness by increasing the thickness of the frame. However, increasing the thickness of the frame causes an increase in the mass of the soundproof structure. This declines the advantage of the present soundproof structure that is lightweight.

Therefore, in order to reduce the increase in mass while maintaining high stiffness, it is preferable to form a hole or a groove in the frame.

In addition, by changing or combining the frame thickness in the plane, it is possible to secure high stiffness and to reduce the weight. In this manner, it is possible to achieve both high stiffness and light weight.

The soundproof structure of the present invention can be used as the following soundproof structures.

For example, as soundproof structures having the soundproof structure of the present invention, it is possible to mention: a soundproof structure for building materials (soundproof structure used as building materials); a soundproof structure for air conditioning equipment (soundproof structure installed in ventilation openings, air conditioning ducts, and the like to prevent external noise); a soundproof structure for external opening portion (soundproof structure installed in the window of a room to prevent noise from indoor or outdoor); a soundproof structure for ceiling (soundproof structure installed on the ceiling of a room to control the sound in the room); a soundproof structure for floor (soundproof structure installed on the floor to control the sound in the room); a soundproof structure for internal opening portion (soundproof structure installed in a portion of the inside door or sliding door to prevent noise from each room); a soundproof structure for toilet (soundproof structure installed in a toilet or a door (indoor and outdoor) portion to prevent noise from the toilet); a soundproof structure for balcony (soundproof structure installed on the balcony to prevent noise from the balcony or the adjacent balcony); an indoor sound adjusting member (soundproof structure for controlling the sound of the room); a simple soundproof chamber member (soundproof structure that can be easily assembled and can be easily moved); a soundproof chamber member for pet (soundproof structure that surrounds a pet's room to prevent noise); amusement facilities (soundproof structure installed in a game centers, a sports center, a concert hall, and a movie theater); a soundproof structure for temporary enclosure for construction site (soundproof member for covering construction site and preventing leakage of a lot of noise around the site); and a soundproof structure for tunnel (soundproof structure installed in a tunnel to prevent noise leaking to the inside and outside the tunnel).

While the soundproof structure of the present invention has been described in detail with reference to various embodiments and examples, the present invention is not limited to these embodiments and examples, and various improvements or modifications may be made without departing from the scope and spirit of the present invention.

EXAMPLES

The soundproof structure of the present invention will be specifically described by way of examples.

Example 1

Figure 4:
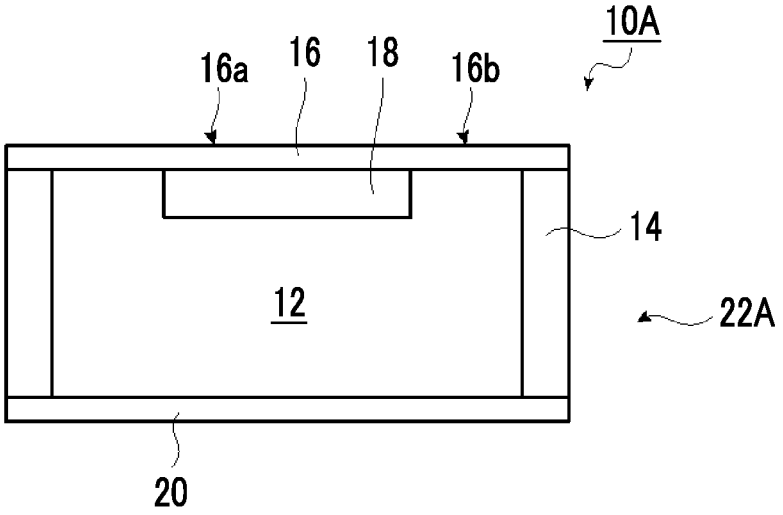
FIG. 4 is a schematic cross-sectional view of the soundproof structure shown in FIG. 3.

First, the soundproof structure 10A of the present invention shown in FIGS. 3 and 4 was manufactured as Example 1.

The soundproof structure 10A shown in FIGS. 3 and 4 was configured to include the soundproof cell 22A having the frame 14, which had the hole portion 12, and the vibratable film 16, which was fixed to the frame 14 so as to cover the hole portion 12.

In Example 1, a PET film (Lumirror manufactured by Toray Industries, Inc., 125 μm in thickness) was used as the film 16. An acrylic piece that had a square shape with a side of 20 mm and had a thickness of 3 mm was disposed at the center of the film 16 formed of a PET film as the protruding portion 18, and was attached to the film 16 with a tape. As the frame 14, a square tube of metal aluminum was used in which the length (rear distance) was 20 mm, the hole portion 12 was a square with an inner side of 40 mm, and the thickness of the outer periphery of the frame 14 for fixing the film 16 was 3 mm. Similarly, a 3 mm-thick metal aluminum square plate with a side of 46 mm was prepared as the rear member 20 and attached to one surface (end portion of the hole portion 12) of the frame structure of the frame 14 to make a lid. A PET film, which was the square film 16 that had a side of 46 mm and had an acrylic piece fixed as the protruding portion 18 at the center, was attached to the frame portion of the other surface of the frame 14. The attachment was performed by bonding using a double-sided tape.

In this manner, the soundproof structure 10A configured to include the soundproof cell 22A shown in FIGS. 3 and 4 was manufactured.

In Example 1, $\rho max/\rho min=25$. The shortest line segment length $\Delta d$ was 10 mm ($10\times10^{-3}$ m). The longest line segment length L was 56.6 mm ($56.6\times10^{-3}$ m).

Comparative Example 1

A soundproof structure based on the related art was manufactured in the same manner as in Example 1 except that on the PET film, there was no protruding portion 18 formed of an acrylic piece that had a square shape with a side of 20 mm and had a thickness of 3 mm.

In Comparative Example 1, $\rho max/\rho min=1$ (no surface density distribution). The soundproof structure of Comparative Example 1 was a standard of the PET film.

First, the acoustic characteristics of the soundproof structures of Example 1 and Comparative Example 1 were measured.

The acoustic measurement was performed as follows using an acoustic tube with an inner diameter of 8 cm, and the absorbance in the soundproof structures of Example 1 and Comparative Example 1 was measured.

Figure 14:
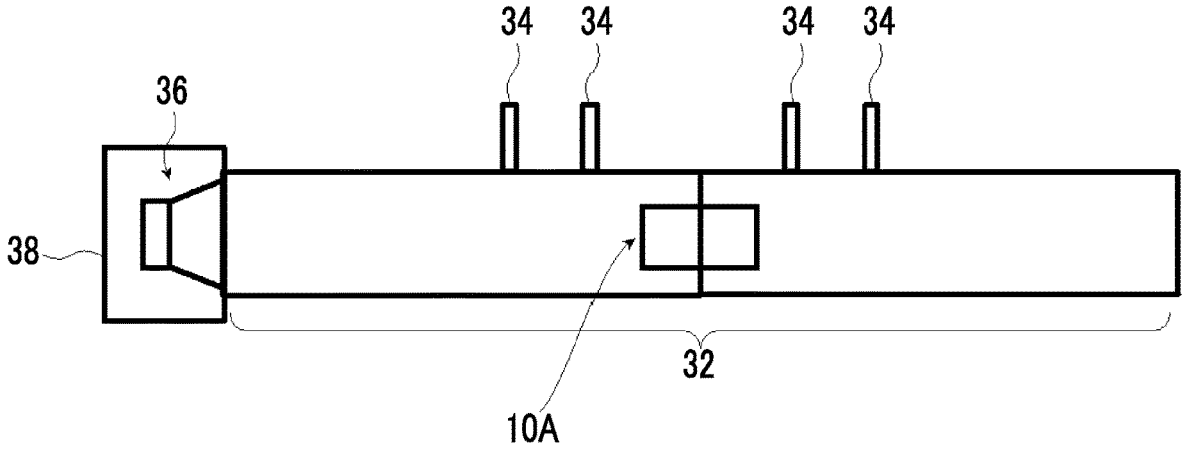
FIG. 14 is a perspective view illustrating an example of a measurement system for measuring the soundproofing performance of a soundproof cell inserted and disposed in a tubular opening member of the soundproof structure of the present invention.

As shown in FIG. 14, the acoustic characteristics were measured by a transfer function method using four microphones 34 in an aluminum acoustic tube (tubular body 32). This method is based on "ASTM E2611-09: Standard Test Method for Measurement of Normal Incidence Sound Transmission of Acoustical Materials Based on the Transfer Matrix Method". As the acoustic tube, for example, the aluminum tubular body 32 based on the same measurement principle as WinZac manufactured by Nitto Bosei Aktien Engineering Co., Ltd. was used. The tubular body 32 was placed in a cylindrical box 38 containing a speaker 36 therein. The sound with a predetermined sound pressure was output from the speaker 34, and was measured using four microphones 34. It is possible to measure the sound transmission loss in a wide spectral band using this method. The soundproof structure 30 of the present embodiment was formed by arranging the soundproof cell 10A of Example 1 at a predetermined measurement portion of the tubular body 32 serving as an acoustic tube such that the film surface of the film 16 of the soundproof cell 10A was inclined, and the sound absorbance and the transmission loss were measured in the range of 100 Hz to 4000 Hz.

Figure 15:
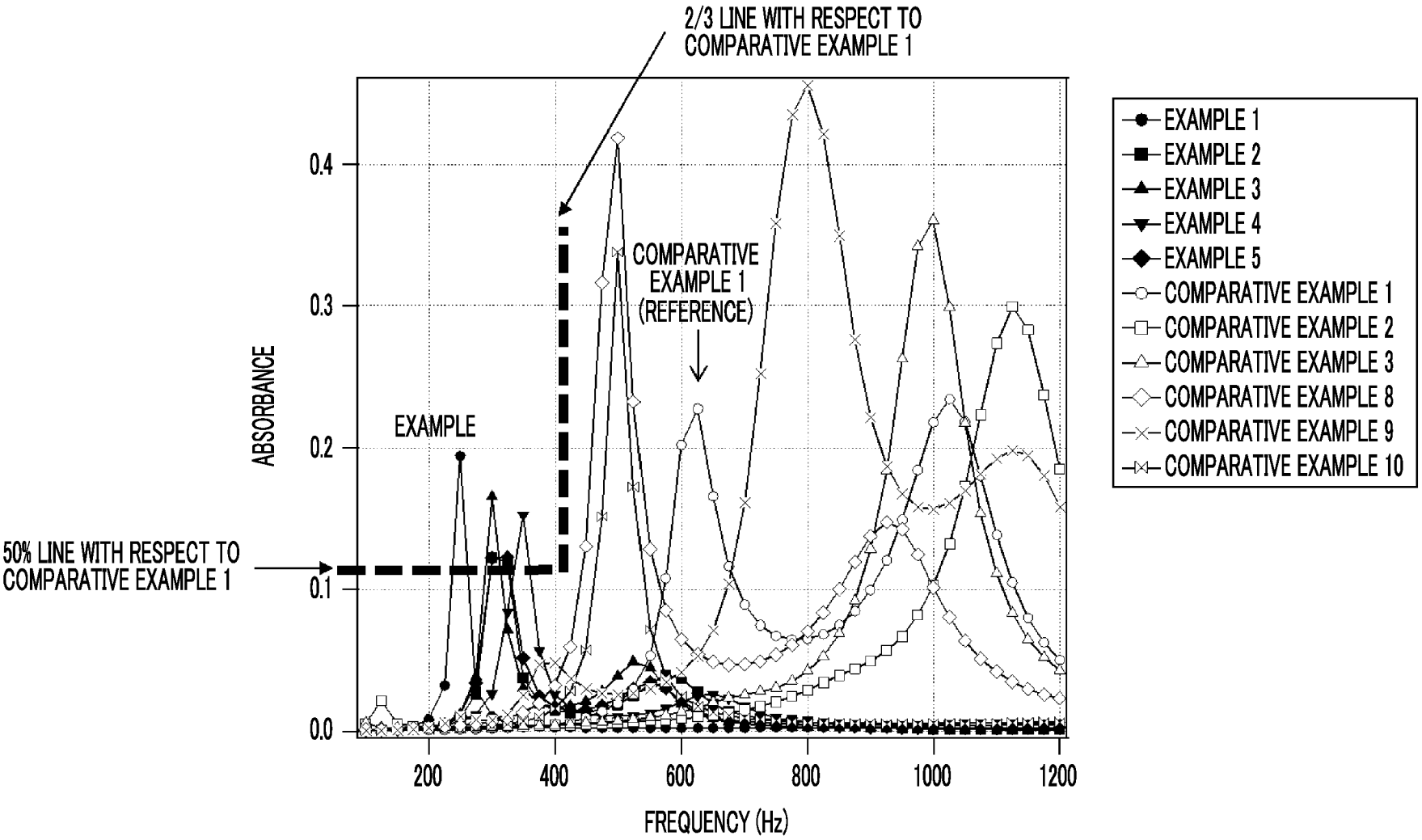
FIG. 15 is a graph showing the sound absorption characteristics in Examples 1 to 5, Comparative Examples 1 to 3, and Comparative Examples 8 to 10 of the present invention.

The results of the measurement of the absorbance of the soundproof structure in Example 1 and Comparative Example 1 are shown in FIG. 15.

For the absorbance peak confirmed on the lowest frequency side of Example 1 using the film 16 of a PET film, the following items were determined.

(Frequency Reduction Determination)

In the case of ⅔ or less of the peak frequency of the absorption peak in a case where there was no protruding portion (corresponding to Comparative Example 1), G (good) was determined. Otherwise, B (bad) was determined.

(Absorbance Determination)

In the case of 50% or more of the absorbance of the absorption peak in a case where there was no protruding portion (corresponding to Comparative Example 1), G was determined. Otherwise, B was determined.

(Conditional Expression Determination)

TRUE was determined in a case where the above Expression (2) was satisfied, and FALSE was determined otherwise. In a case where there was no film surface density, NULL was set since whether or not the conditional expression was satisfied could not be determined. These determination results of Example 1 are shown in Table 1.

Example 2

A soundproof structure, which was the same as that in Example 1 except for a PET film in which 3×3 (9) acrylic pieces (square shape having a height of 3 mm and a side of 6.7 mm) were uniformly disposed at intervals of 6.7 mm on the film 16, was manufactured.

In Example 2, $\rho max/\rho min=25$. The shortest line segment length $\Delta d$ was 3.3 mm ($3.3\times10^{-3}$ m). The longest line segment length L was 56.6 mm ($56.6\times10^{-3}$ m).

Example 3

A soundproof structure 10 configured to include the soundproof cell 22 shown in FIGS. 1 and 2, which was the same as the soundproof structure in Example 1 except for a PET film in which 5×5 (25) acrylic pieces (square shape having a height of 3 mm and a side of 4 mm) were uniformly disposed at intervals of 4 mm on the film 16, was manufactured.

In Example 3, ρmax/ρmin=25. The shortest line segment length Δd was 2.0 mm ($2.0\times10^{-3}$ m). The longest line segment length L was 56.6 mm ($56.6\times10^{-3}$ m).

Example 4

A soundproof structure, which was the same as that in Example 1 except for a PET film in which 10×10 (100) acrylic pieces (square shape having a height of 3 mm and a side of 2 mm) were uniformly disposed at intervals of 2 mm on the film 16, was manufactured.

In Example 4, ρmax/ρmin=25. The shortest line segment length Δd was 1.0 mm ($1.0\times10^{-3}$ m). The longest line segment length L was 56.6 mm ($56.6\times10^{-3}$ m).

Example 5

Figure 5:
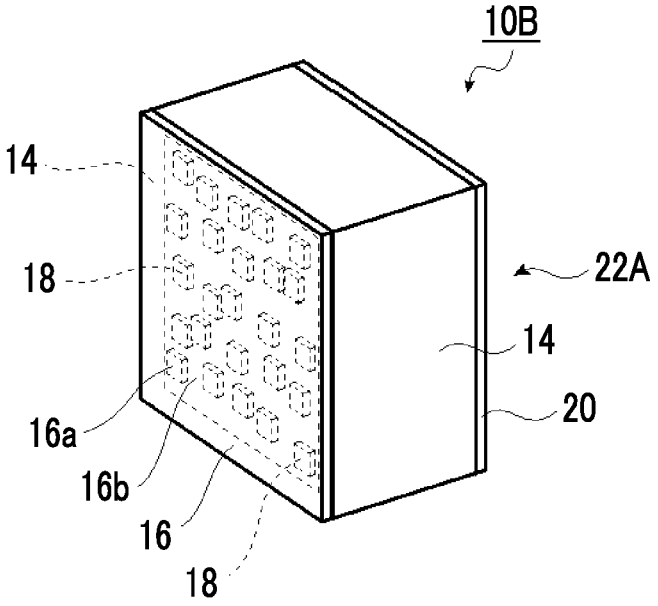
FIG. 5 is a schematic perspective view of another example of the soundproof structure according to the present invention.
Figure 6:
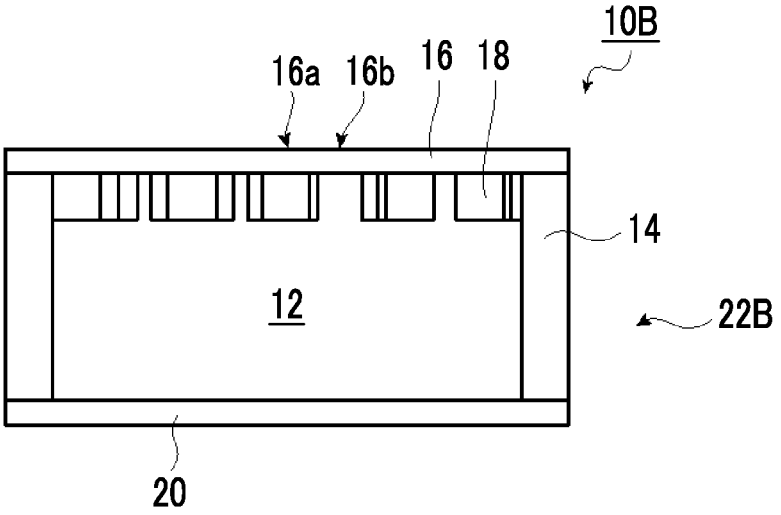
FIG. 6 is a schematic cross-sectional view of the soundproof structure shown in FIG. 5.

A soundproof structure 10B configured to include the soundproof cell 22B shown in FIGS. 5 and 6, which was the same as the soundproof structure in Example 1 except for a PET film in which 5×5 (25) acrylic pieces (square shape having a height of 3 mm and a side of 4 mm) were irregularly disposed on the film 16, was manufactured.

In Example 5, ρmax/ρmin=25. The shortest line segment length Δd was 0.5 mm ($0.5\times10^{-3}$ m). The longest line segment length L was 56.6 mm ($56.6\times10^{-3}$ m).

First, the acoustic characteristics of the soundproof structures of Examples 2 to 5 were measured.

The results of the measurement of the absorbance in Examples 2 to 5 are shown in FIG. 15.

Then, the frequency reduction determination, the absorbance determination, and the conditional expression determination were performed for each of Examples 2 to 5.

The determination results of Examples 2 to 5 are shown in Table 1.

Example 6

A soundproof structure, which was the same as that in Example 1 except that the material of the film 16 was a silicone rubber film having a thickness of 50 μm and 10×10 (100) weights (square shape having a height of 0.5 mm and a side of 2 mm) formed of Cu were uniformly bonded and disposed at intervals of 2 mm on the film 16 with a double-sided tape, was manufactured.

In Example 6, ρmax/ρmin=53. The shortest line segment length Δd was 1.0 mm ($1.0\times10^{-3}$ m). The longest line segment length L was 56.6 mm ($56.6\times10^{-3}$ m).

Comparative Example 4

A soundproof structure based on the related art was manufactured in the same manner as in Example 6 except that there was no weight formed of Cu on the film.

In Comparative Example 4, ρmax/ρmin=1 (no surface density distribution).

The soundproof structure of Comparative Example 4 was a standard of the silicone rubber film.

First, the acoustic characteristics of the soundproof structures of Example 6 and Comparative Example 4 were measured as described above.

Figure 16:
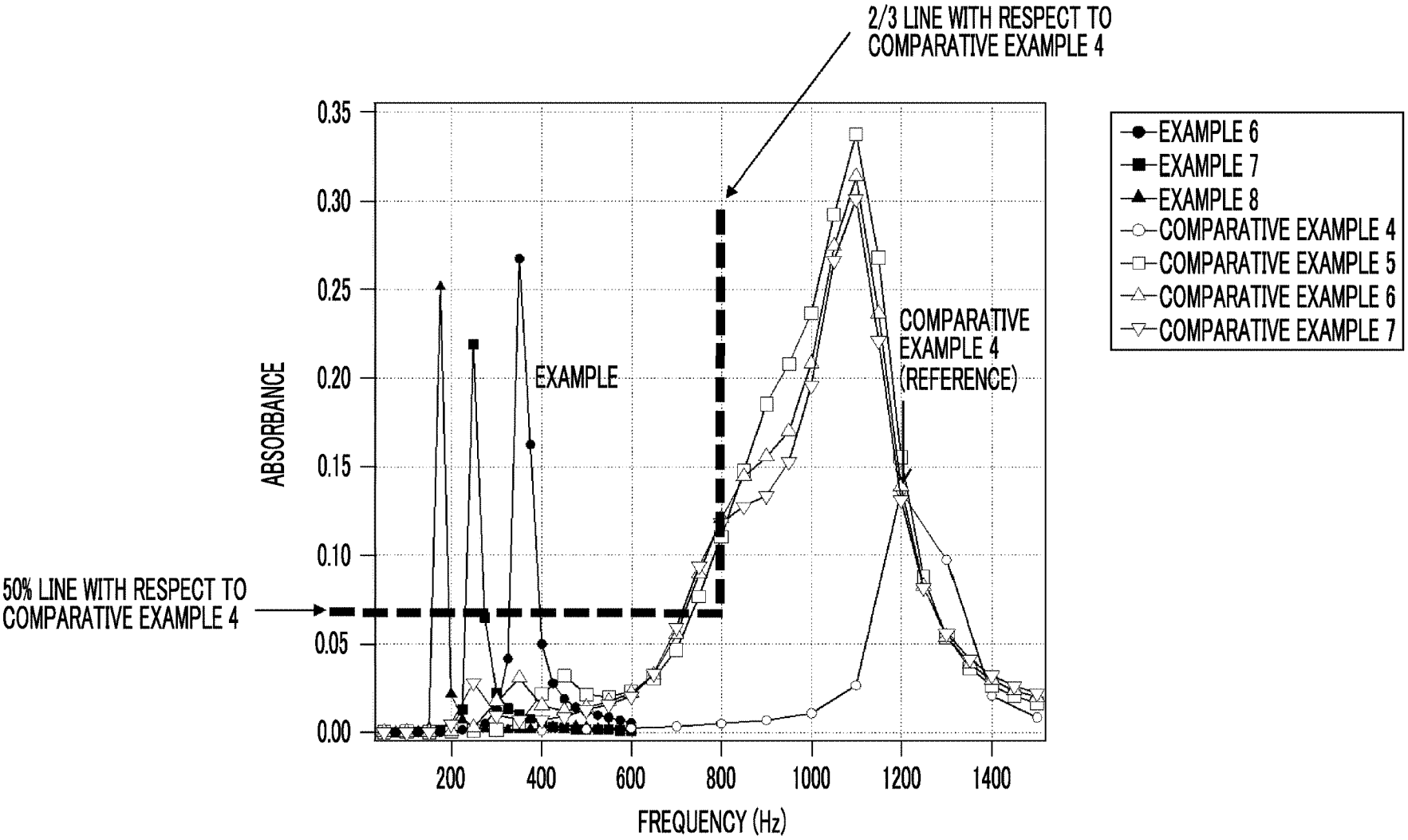
FIG. 16 is a graph showing the sound absorption characteristics in Examples 6 to 8 and Comparative Examples 4 to 7 of the present invention.

The results of the measurement of the absorbance are shown in FIG. 16.

For the absorbance peak confirmed on the lowest frequency side of Example 6 using the film 16 of a silicone rubber film, the following items were determined.

(Frequency Reduction Determination)

In the case of ⅔ or less of the peak frequency of the absorption peak in a case where there was no protruding portion (corresponding to Comparative Example 4), G (good) was determined. Otherwise, B (bad) was determined.

(Absorbance Determination)

In the case of 50% or more of the absorbance of the absorption peak in a case where there was no protruding portion (corresponding to Comparative Example 4), G was determined. Otherwise, B was determined.

(Conditional Expression Determination)

TRUE was determined in a case where the above Expression (2) was satisfied, and FALSE was determined otherwise. In a case where there was no film surface density, NULL was set since whether or not the conditional expression was satisfied could not be determined.

These determination results of Example 6 are shown in Table 1.

Example 7

A soundproof structure, which was the same as that in Example 6 except that 10×10 (100) weights (square shape having a height of 1.0 mm and a side of 2 mm) formed of Cu were uniformly bonded and disposed at intervals of 2 mm on the film 16 with a double-sided tape, was manufactured.

In Example 7, ρmax/ρmin=104. The shortest line segment length Δd was 1.0 mm ($1.0\times10^{-3}$ m). The longest line segment length L was 56.6 mm ($56.6\times10^{-3}$ m).

Example 8

A soundproof structure, which was the same as that in Example 6 except that 10×10 (100) weights (square shape having a height of 2.0 mm and a side of 2 mm) formed of Cu were uniformly bonded and disposed at intervals of 2 mm on the film 16 with a double-sided tape, was manufactured.

In Example 7, ρmax/ρmin=208. The shortest line segment length Δd was 1.0 mm ($1.0\times10^{-3}$ m). The longest line segment length L was 56.6 mm ($56.6\times10^{-3}$ m).

First, the acoustic characteristics of the soundproof structures of Examples 7 and 8 were measured.

The results of the measurement of the absorbance in Examples 7 and 8 are shown in FIG. 16.

Then, the frequency reduction determination, the absorbance determination, and the conditional expression determination in a case where the film 16 of the above-described silicone rubber film was used were performed for each of Examples 7 and 8.

The determination results of Examples 7 and 8 are shown in Table 1.

Comparative Example 2

A soundproof structure, which was the same as that in Example 1 except for a PET film in which one protruding portion (square shape having a height of 18.75 mm and a side of 8 mm) was disposed at the center of the film, was manufactured.

In Comparative Example 2, ρmax/ρmin=151. The shortest line segment length Δd was 16 mm ($16\times10^{-3}$ m). The longest line segment length L was 56.6 mm ($56.6\times10^{-3}$ m).

Comparative Example 3

A soundproof structure, which was the same as that in Example 1 except for a PET film in which one Cu weight (square shape having a height of 11.7 mm and a side of 4 mm) was disposed at the center of the film, was manufactured.

In Comparative Example 3, ρmax/ρmin=601. The shortest line segment length Δd was 18 mm ($18\times10^{-3}$ m). The longest line segment length L was 56.6 mm ($56.6\times10^{-3}$ m).

First, the acoustic characteristics of the soundproof structures of Comparative Examples 2 and 3 were measured.

The results of the measurement of the absorbance in Comparative Examples 2 and 3 are shown in FIG. 15.

Then, the frequency reduction determination, the absorbance determination, and the conditional expression determination in a case where the film of the above-described PET film was used were performed for each of Comparative Examples 2 and 3.

The determination results of Comparative Examples 2 and 3 are shown in Table 1.

Comparative Example 5

A soundproof structure, which was the same as that in Example 6 except that 5×5 (25) weights (square shape having a height of 0.5 mm and a side of 4 mm) formed of Cu were uniformly bonded and disposed at intervals of 4 mm on the film with a double-sided tape, was manufactured.

In Comparative Example 5, ρmax/ρmin=53. The shortest line segment length Δd was 2.0 mm ($2.0\times10^{-3}$ m). The longest line segment length L was 56.6 mm ($56.6\times10^{-3}$ m).

Comparative Example 6

A soundproof structure, which was the same as that in Example 6 except that 5×5 (25) weights (square shape having a height of 1.0 mm and a side of 4 mm) formed of Cu were uniformly bonded and disposed at intervals of 4 mm on the film with a double-sided tape, was manufactured.

In Comparative Example 6, ρmax/ρmin=105. The shortest line segment length Δd was 2.0 mm ($2.0\times10^{-3}$ m). The longest line segment length L was 56.6 mm ($56.6\times10^{-3}$ m).

Comparative Example 7

A soundproof structure, which was the same as that in Example 6 except that 5×5 (25) weights (square shape having a height of 2.0 mm and a side of 4 mm) formed of Cu were uniformly bonded and disposed at intervals of 4 mm on the film with a double-sided tape, was manufactured.

In Example 7, ρmax/ρmin=210. The shortest line segment length Δd was 2.0 mm ($2.0\times10^{-3}$ m). The longest line segment length L was 56.6 mm ($56.6\times10^{-3}$ m).

First, the acoustic characteristics of the soundproof structures of Comparative Examples 5 to 7 were measured.

The results of the measurement of the absorbance in Comparative Examples 5 to 7 are shown in FIG. 16.

Then, the frequency reduction determination, the absorbance determination, and the conditional expression determination in a case where the film of the above-described silicone rubber film was used were performed for each of Comparative Examples 5 to 7.

The determination results of Comparative Examples 5 to 7 are shown in Table 1.

Comparative Example 8

A soundproof structure, which was the same as that in Comparative Example 1 except that the length (rear distance) of the frame 14 was 40 mm, was manufactured.

Comparative Example 9

A soundproof structure, which was the same as that in Comparative Example 1 except that the hole portion 12 of the frame 14 was a square having a side of 55 mm, was manufactured.

Comparative Example 10

A soundproof structure, which was the same as that in Example 1 except for a PET film in which one protruding portion (square shape having a height of 0.5 mm and a side of 20 mm) was disposed at the center of the film, was manufactured.

In Comparative Example 10, ρmax/ρmin=5. The shortest line segment length Δd was 10 mm ($10\times10^{-3}$ m). The longest line segment length L was 56.6 mm ($56.6\times10^{-3}$ m).

First, the acoustic characteristics of the soundproof structures of Comparative Examples 8 to 10 were measured.

The results of the measurement of the absorbance in Comparative Examples 8 to 10 are shown in FIG. 15.

Then, the frequency reduction determination, the absorbance determination, and the conditional expression determination in a case where the film of the above-described PET film was used were performed for each of Comparative Examples 8 to 10.

The determination results of Comparative Examples 8 to 10 are shown in Table 1.

TABLE 1

| — | Film material | $Eh^2$ [N] | Parameter X [N] | Δd/L | Frequency reduction determination | Absorbance determination | Conditional expression determination |
|---|---|---|---|---|---|---|---|
| Example 1 | PET | 70.3 | 2.81E+00 | 0.177 | G | G | TRUE |
| Example 2 | PET | 70.3 | 2.81E+00 | 0.058 | G | G | TRUE |
| Example 3 | PET | 70.3 | 2.81E+00 | 0.035 | G | G | TRUE |
| Example 4 | PET | 70.3 | 2.81E+00 | 0.018 | G | G | TRUE |
| Example 5 | PET | 70.3 | 2.81E+00 | 0.009 | G | G | TRUE |
| Example 6 | Silicone | 0.05 | 9.43E−04 | 0.018 | G | G | TRUE |
| Example 7 | Silicone | 0.05 | 4.76E−04 | 0.018 | G | G | TRUE |
| Example 8 | Silicone | 0.05 | 2.38E−04 | 0.018 | G | G | TRUE |
| Comparative Example 1 | PET | 70.3 | 3.35E−01 | 0.283 | — | — | NULL |
| Comparative Example 2 | PET | 70.3 | 4.69E−01 | 0.318 | B | B | FALSE |

TABLE 1-continued

| — | Film material | $Eh^2$ [N] | Parameter X [N] | Δd/L | Frequency reduction determination | Absorbance determination | Conditional expression determination |
|---|---|---|---|---|---|---|---|
| Comparative Example 3 | PET | 70.3 | 1.17E−01 | 0.177 | B | B | FALSE |
| Comparative Example 4 | Silicone | 0.05 | 5.00E−02 | — | — | — | NULL |
| Comparative Example 5 | Silicone | 0.05 | 4.76E−04 | 0.035 | B | B | FALSE |
| Comparative Example 6 | Silicone | 0.05 | 4.76E−04 | 0.035 | B | B | FALSE |
| Comparative Example 7 | Silicone | 0.05 | 2.38E−04 | 0.035 | B | B | FALSE |
| Comparative Example 8 | PET | 70.3 | 7.03E+01 | — | B | G | NULL |
| Comparative Example 9 | PET | 70.3 | 7.03E+01 | — | B | B | NULL |
| Comparative Example 10 | PET | 70.3 | 1.41E+01 | 0.018 | B | G | FALSE |

FIG. 15 shows the acoustic characteristics in Examples 1 to 5 and Comparative Examples 1 to 3 and 8 to 10.

From FIG. 15 and Table 1, it can be seen that, comparing these Examples 1 to 5 with Comparative Examples 1 to 3 and 8 to 10, in the case of Examples 1 to 5 satisfying the conditional expression (2) of the present invention, the peak frequency is equal to or less than ⅔ of that in Comparative Example 1 and the absorbance is equal to or greater than the half of that in Comparative Example 1 and accordingly the effectiveness of the present invention is shown.

In Comparative Example 10, only the inequality on the left side of Expression (2) is satisfied. Therefore, it can be seen that the absorbance determination is sufficient but the frequency reduction is insufficient (not equal to or less than ⅔ of that in Comparative Example 1).

FIG. 16 shows the acoustic characteristics in Examples 6 to 8 and Comparative Examples 5 to 7.

From FIG. 16 and Table 1, it can be seen that, comparing these Examples 6 to 8 with Comparative Examples 4 to 7, in the case of Examples 6 to 8 satisfying the conditional expression (2) of the present invention, the peak frequency is equal to or less than ⅔ of that in Comparative Example 4 and the absorbance is equal to or greater than the half of that in Comparative Example 4 and accordingly the effectiveness of the present invention is shown.

From the above, the effect of the present invention is obvious.

EXPLANATION OF REFERENCES

10, 10A, 10B, 10C, 10D, 10E, 10F: soundproof structure
12: hole portion
14: frame
16, 24: film
16*a*, 26*a*: high surface density region
16*b*, 26*b*: low surface density region
18: protruding portion
20: rear member
22, 22A, 22B, 22C, 22D, 22E, 22F: soundproof cell
26: laminated film

What is claimed is:

1. A soundproof structure comprising:

at least one soundproof cell which comprises a frame having a hole portion and a film fixed to the frame so as to cover the hole portion and in which a rear space of the film is closed, wherein the film has a surface density distribution including at least one high surface density region and a low surface density region, the at least one high surface density region comprises a plurality of high surface density regions which are disposed on an entire surface of the film, and assuming that a shortest line segment length among line segments connecting end portions of the high surface density regions adjacent to each other and line segments connecting the high surface density regions and end portions of the hole portions of the frame to each other is Δd [m], a longest line segment length among line segments connecting the end portions of the hole portions of the frame to each other is L [m], a Young's modulus of a material of the low surface density region is E [Gpa], an average film thickness of the low surface density region is h [m], a maximum surface density of the film is ρmax, and a minimum surface density of the film is ρmin, a parameter X of the film defined by the following Equation (1) satisfies the following Inequality (2)

$$X=Eh^2/(\rho max/\rho min)[N] \quad (1)$$

$$(\Delta d/L-0.025)/(0.06)[N]\leq X[N]\leq 10[N] \quad (2).$$

2. The soundproof structure according to claim 1, wherein a ratio ρmax/ρmin between the maximum surface density ρmax of the film and the minimum surface density ρmin of the film is 1.5 or more.

3. The soundproof structure according to claim 1, wherein the film is formed of two or more kinds of materials.

4. The soundproof structure according to claim 1, wherein the film has a protruding portion or a weight forming the at least one high surface density region.

5. The soundproof structure according to claim 4, wherein the film having the protruding portion is a resin film having unevenness.

6. The soundproof structure according to claim 1, wherein the film and the frame are integrally formed.

7. The soundproof structure according to claim 1, wherein the soundproof cell is smaller than a wavelength of a first natural vibration frequency of the film.

8. The soundproof structure according to claim 7, wherein the first natural vibration frequency is 100000 Hz or less.

9. The soundproof structure according to claim 1, wherein the soundproof structure has a structure in which one or more soundproof cells are disposed in an opening member having an opening.

10. The soundproof structure according to claim 9, wherein the soundproof cell is disposed in the opening member in a state in which a film surface of the film is inclined with respect to an opening cross section of the opening member and a region serving as a ventilation hole through which gas passes is provided in the opening member.

11. A method of manufacturing the soundproof structure according to claim 4, the method comprising:

manufacturing the film having the protruding portion by forming unevenness on the film by resin molding or imprinting.

12. A method of manufacturing the soundproof structure according to claim 1, the method comprising:

forming the film and the frame together with a 3D printer.

* * * * *